US011773613B2

(12) United States Patent
Bruns et al.

(10) Patent No.: US 11,773,613 B2
(45) Date of Patent: Oct. 3, 2023

(54) MODULAR CONFIGURABLE HOSPITAL SYSTEM AND METHOD

(71) Applicant: THE BOLDT GROUP, INC., Appleton, WI (US)

(72) Inventors: Ben Bruns, Neenah, WI (US); Kurt Spiering, Wauwatosa, WI (US)

(73) Assignee: THE BOLDT GROUP, INC., Appleton, WI (US)

( * ) Notice: Subject to any disclaimer, the term of this patent is extended or adjusted under 35 U.S.C. 154(b) by 0 days.

(21) Appl. No.: 17/308,702

(22) Filed: May 5, 2021

(65) Prior Publication Data

US 2021/0348407 A1 Nov. 11, 2021

Related U.S. Application Data

(60) Provisional application No. 63/020,358, filed on May 5, 2020.

(51) Int. Cl.
*E04H 3/08* (2006.01)
*E04H 1/00* (2006.01)

(52) U.S. Cl.
CPC ..... *E04H 3/08* (2013.01); *E04H 1/005* (2013.01)

(58) Field of Classification Search
CPC ..... E04H 3/08; E04H 1/005
See application file for complete search history.

(56) References Cited

U.S. PATENT DOCUMENTS 3,540,173 A * 11/1970 Johnides ..... E04H 3/08 52/79.5
4,425,978 A 1/1984 Star
4,599,829 A * 7/1986 DiMartino, Sr. ..... E04B 1/3483 52/106
4,915,435 A * 4/1990 Levine ..... A61G 3/001 29/428
5,727,353 A 3/1998 Getz et al.
5,755,479 A * 5/1998 Lavin ..... A61G 7/05 5/503.1
6,179,358 B1 1/2001 Hirayama et al.
6,243,993 B1 6/2001 Swensson
6,330,771 B1 * 12/2001 Hester, Jr. ..... E04H 3/08 52/234

(Continued)

FOREIGN PATENT DOCUMENTS

DE 10149046 4/2003
EP 1672144 6/2006

(Continued)

*Primary Examiner* — Rodney Mintz
(74) *Attorney, Agent, or Firm* — RYAN KROMHOLZ & MANION, S.C.

(57) ABSTRACT

A modular configurable hospital system is provided. The system comprises at least one unit. The system is configured with at least one patient care unit, which comprises at least one of a patient care room and a ward. The patient care units are sealably configured into at least one patient care section, and arranged end to end. A support care section, having at least one support care unit, may be provided for providing space for working, storage and other services for those working in the system. The system may be sealably configured in numerous combinations to adapt to the immediate needs of the situation, and installed indoors and in the external environment. A method of operation of the system is provided.

14 Claims, 18 Drawing Sheets

(56) References Cited

U.S. PATENT DOCUMENTS 6,772,563 B2 8/2004 Kuhn
7,143,050 B2 11/2006 Crane
7,540,546 B2 * 6/2009 Kern ..... A61G 3/001 296/193.04
7,784,845 B2 8/2010 Kim et al.
7,794,001 B2 9/2010 Blackwell
7,985,382 B1 7/2011 Henry et al.
8,151,537 B2 * 4/2012 Pope ..... E04B 1/3431 52/741.1
8,707,633 B2 * 4/2014 Han ..... E04B 1/3442 52/79.5
9,308,141 B2 4/2016 Blackwell et al.
9,516,944 B2 12/2016 Lawrence
9,518,748 B2 * 12/2016 Holtz ..... B01L 1/04
9,611,637 B2 4/2017 Dynon
9,757,078 B1 9/2017 Robertson
9,795,957 B2 * 10/2017 Holtz ..... B01L 1/04
10,161,147 B2 12/2018 Jornitz
10,167,645 B2 1/2019 Geiger
10,407,897 B2 9/2019 Leibinger et al.
10,492,970 B2 12/2019 Merino et al.
10,533,758 B2 * 1/2020 Jornitz ..... E04H 1/1205
10,865,582 B2 * 12/2020 Roberts ..... E04H 9/04
11,103,406 B1 * 8/2021 Channell ..... E04H 3/08
2007/0102946 A1 * 5/2007 Blackwell ..... E04H 3/08 296/24.38
2007/0228692 A1 * 10/2007 Kern ..... A61G 3/001 280/403
2008/0184631 A1 8/2008 Schofield
2008/0221919 A1 9/2008 Cates
2008/0313973 A1 * 12/2008 Butler Rolf ..... E04H 3/08 52/741.1
2010/0139179 A1 6/2010 Smith et al.
2011/0053486 A1 * 3/2011 Holtz ..... F24F 3/16 29/428
2011/0173898 A1 7/2011 Denicourt et al.
2012/0265005 A1 * 10/2012 Han ..... E04H 3/08 600/21
2013/0109291 A1 * 5/2013 Holtz ..... B01L 1/04 29/428
2013/0154296 A1 6/2013 Blackwell et al.
2013/0233575 A1 9/2013 McCoy et al.
2013/0276383 A1 * 10/2013 Grange ..... E04H 1/12 52/79.9
2016/0010883 A1 * 1/2016 Jornitz ..... F24F 3/167 29/897.3
2016/0069062 A1 3/2016 Dynon
2016/0128886 A1 5/2016 Merino et al.
2016/0130795 A1 * 5/2016 Downey ..... E04H 1/005 52/745.02
2016/0333569 A1 11/2016 Johnston
2016/0348387 A1 12/2016 Geiger
2017/0130447 A1 5/2017 Lane, Jr. et al.
2017/0260763 A1 * 9/2017 Fortin ..... E04H 5/00
2017/0321443 A1 * 11/2017 Biffiger ..... E04H 5/02
2017/0328054 A1 * 11/2017 Bakken ..... E04H 1/005
2019/0136553 A1 5/2019 Geiger
2020/0190841 A1 * 6/2020 Roberts ..... E04B 1/348
2022/0356698 A1 * 11/2022 Bruns ..... E04H 3/08

FOREIGN PATENT DOCUMENTS

EP 3091132 1/2016
EP 3263789 1/2018

* cited by examiner

MODULAR CONFIGURABLE HOSPITAL SYSTEM AND METHOD

RELATED APPLICATION

This application claims the benefit of provisional application Ser. No. 63/020,350 filed 5 May 2020.

FIELD OF THE INVENTION

The present disclosure generally relates to hospital units. Most specifically the present disclosure relates to mobile hospital units, and more specifically to modular configurable hospital systems.

BACKGROUND OF THE INVENTION

Whether in war, under environmental emergencies, during health emergencies, such as pandemics, or in the efforts to meet a growing client population, healthcare institutions are under increased stress to provide increased patient care and related systems cost effectively.

The prior art illustrates inventions for mobile hospital units. However, a number of such inventions are to units which are self-contained without the ability to create a modular system using multiple units. The prior art does disclose certain modular systems created from more than one unit. In both the case of self-contained units and modular units, a small number of the prior art illustrates that such units are transportable. Such transportation may be by tractor-trailer. However, some of the inventions of the prior art provide for mounting the unit upon trailer frames with axles. Further, the prior art illustrates that expandable areas are required due to the inability to fulfill the demands in a predefined space.

The prior art has provided for non-expandable modular units. However, in such inventions the units not only are for the patient spaces but for the common corridor/hallways areas as well. Applying units to create common corridor/hallways increases the potential cost of the project. Further, the prior art illustrates such units are attached with a defined locking mechanism, thereby limiting the possible orientations of the units with respect to one another as well as the layout of completed modular unit systems. Using such mechanisms the prior art does not allow for non-common corridor/hallway units, patient care and support units, to be attached end to end. An end to end orientation of such units would provide for potential cost savings in patient care and more efficiency in movement between patient care units. Finally, the prior illustrates the units are developed using container boxes or through the use of metal structural beams in a traditional frame structure. Finally, placing the healthcare workers and patients in a position of increased protection is paramount. Thus, the attachment of the units needs to go beyond just providing space for operations. This attachment needs to provide for a controlled environment of operations within the system.

A need exists for a modular unit system, which provides for combining the units to create a controlled environment of operation within the system.

A need exists for a modular unit system comprising units which are transportable upon a tractor-trailer flatbed.

A need exists for a modular unit system composed of non-common corridor/hallway area units.

A need exists for a modular unit system, which provides for combining the units in a manner not limited by the mechanism for combining the units.

A need exists for a modular unit system comprising units made not exclusively of metal structural beams.

A need exists for modular units, which are prefabricated and provide for an expandable system.

A need exists for a modular system, which is able to be self-sufficient or connected to an existing electrical and air supply framework to provide hospital grade patient care.

A need exists for separate patient care units to be attached end to end, optimizing costs and patient care.

A need exists for immediate access to personal protection features at the patient care unit.

A need exists for a method of operation ensuring efficient and safe operation of the system.

SUMMARY OF THE INVENTION

The present disclosure generally relates to hospital units. Most specifically the present disclosure relates to mobile hospital units, and more specifically to modular configurable hospital systems.

The modular configurable hospital system comprises at least one unit. The system is configured with at least one embodiment of a patient care unit, which comprises at least one of a patient care room and a patient ward. The patient care units are configured into at least one patient care section.

The system may comprise units forming a support care section, wherein such units are support care units. The support units may be provided for providing space for working, storage and other services for those working in the system. The supports units may be composed of alternative embodiments.

The system is configured such that patient care units are attached to one another to create a seal providing for a controlled environment of operation, which includes arresting and managing the movement of airborne and non-airborne particles into and out of the system. Patient care units can be paired end to end.

Support units are attached to one another to create a seal providing for a controlled environment of operation, which includes arresting and managing the movement of airborne and non-airborne particles into and out of the patient sections and support sections are attached to one another to create a seal providing for a controlled environment of operation, which includes arresting and managing the movement of airborne and non-airborne particles into and out of the system.

The system may be configured in numerous orientations to adapt to the immediate needs of the situation.

The system may be installed indoors and outdoors.

The system is designed such that orientation of the units may create common corridor/hallways of the system.

The units are designed to be transportable using a tractor-trailer flatbed, a train, an airplane, or a helicopter.

Walls of the units are a frame structure comprised of beams made of at least one of fibrous material and metal.

A method of operation of the system is described to ensure efficient and safe operation of the system.

An intended benefit of the invention provides for a modular unit system comprising units, which are transportable upon a tractor-trailer flatbed.

An intended benefit of this invention provides for a system composed of non-common corridor/hallway area units.

An intended benefit of this invention provides for combining the units in a manner not limited by the mechanism for combining the units.

An intended benefit of this invention provides for a modular unit system comprising units made not exclusively of metal structural beams.

An intended benefit of this invention provides for modular units, which are prefabricated and provide for an expandable system.

An intended benefit of this invention provides for a modular system, which is able to be self-sufficient or connected to an existing electrical and air supply framework to provide hospital grade patient care.

An intended benefit of this invention provides for separate patient care units to be attached end to end.

An intended benefit of this invention provides for immediate access to personal protection features at the patient care unit.

An intended benefit of this invention provides for a method of operation ensuring efficient and safe operation of the system.

BRIEF DESCRIPTION OF THE DRAWINGS

The disclosure can be better understood with reference to the following drawings and description. The components in the figures are not necessarily to scale, emphasis instead being placed upon illustrating the principles of the disclosure.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is described in the specification.

Solutions have been provided in mobile hospital care, with some using multiple units in a modular configuration. However, the configurations of such prior art units is limited to specific configurations. Further, the prior art systems require a separate common corridor/hallway unit for construction of the system. The costs associated with such limitations reduce the benefit of the modular hospital system. The units of the present invention are configurable along a transverse axis of the unit. The units are combined with one another in such a fashion to create a seal, thereby providing a controlled environment of operation within the system. Additionally, the units are combined without the need for a locking mechanism. This allows for the system to be expandable and rearranged easily and efficiently. The units are transportable upon a tractor-trailer flatbed, airplane or train car reducing transportation cost per unit. The system is a separate unit, which is stand alone or attached to an existing structure, and therefore has specific locations for personnel to immediately access personal protection features. Thus, the present invention has optimized the efficiency of patient care, provided greater options in building layout for expanded healthcare units, and reduced the costs associated with expanding patient care.

Figure 1A:
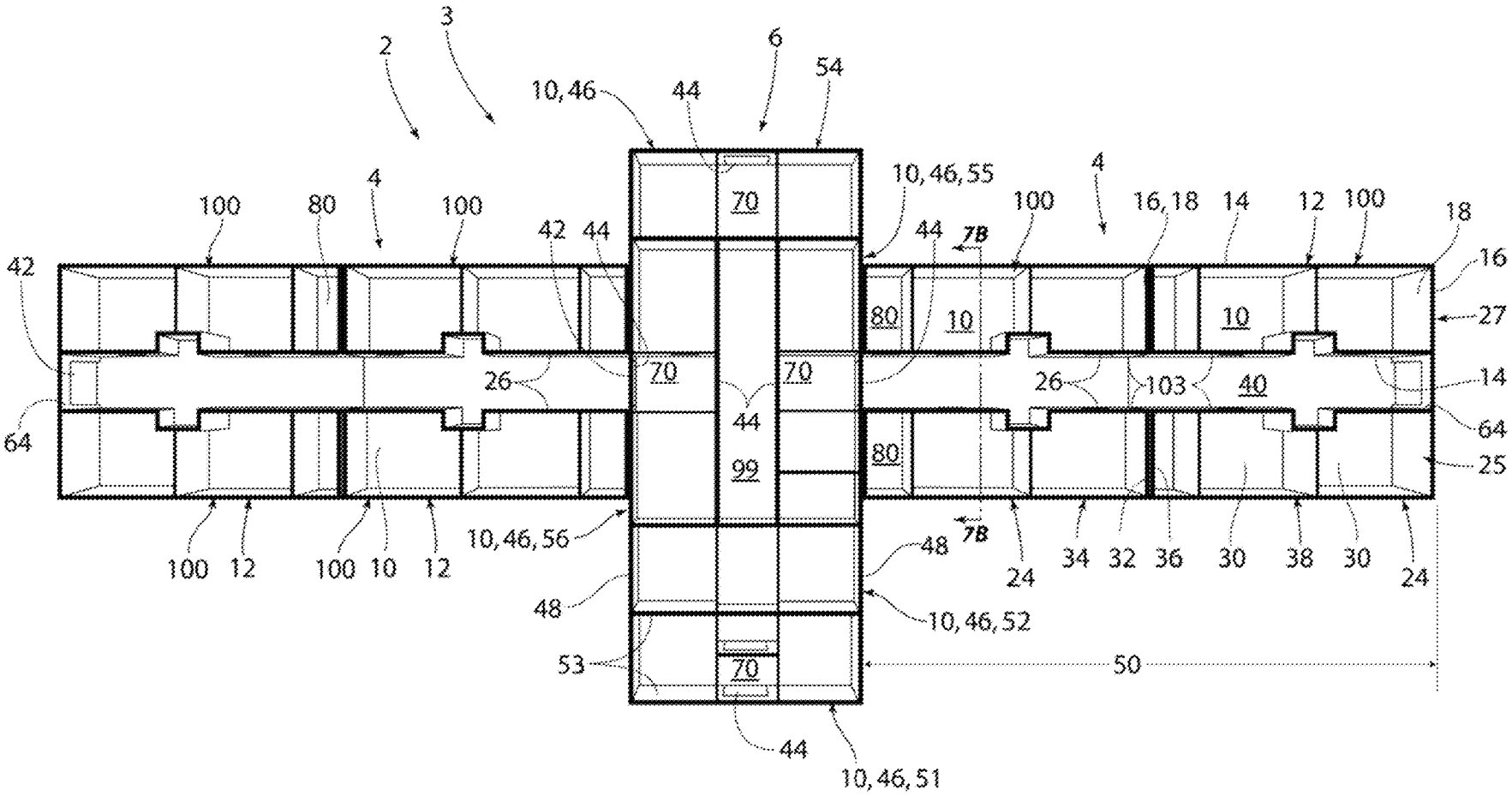
FIG. 1A is a top view of an example of a first embodiment of a tier of the modular configurable hospital system of the invention.

With attention to FIG. 1A, an example of a first embodiment of a tier 3 of the modular configurable hospital system 2 is illustrated. The system 2, and tier 3, is a modular system comprising multiple units 10 which shall be described. As later described, it is understood that more than one tier 3 may comprise the system 2. The combination of such units allows for optimization of costs and patient care. The system 2, and tier 3, may comprise one or more units 10. Further, the orientation of the units 10 with respect to one another can be changed to meet both dimensional requirements, patient care requirements and other business and environmental factors.

The system 2, and tier 3, comprises two patient care sections 4 separated by a support section 6. The connection between the patient section and the support section creates a seal. This seal provides for controlling the environment within the system, e.g. managing the movement of airborne and non-airborne particles into and out of the system, air distribution within the system and temperature control within the system. Each patient care section 4 comprises at least one patient care unit 12. Each patient care unit 12 has a rectangular shape or floorplan. Alternatively, the unit 12 may have a square shape or floorplan. Each patient care unit 12 has parallel long axis sides 14 separated by oppositely opposed transverse sides 16, forming the ends 18 of the patient care unit 12. In the example of the system 2 illustrated in FIG. 1A, each patient care section 4 comprises four patient care units 12. Along one long axis side 14 of each patient care unit 12, two patient care room doors 26 open into the patient care unit 12. Specifically, each door 26 opens into a separate patient care room 30 of the patient care unit 12. The patient care units 12 of the system 2, and tier 3, are a first embodiment of the patient care unit 100. The first embodiment of the patient care unit 100 is an airborne infectious isolation unit or intensive care unit. At least one room 30 of the unit 100 may be a critical care airborne infectious isolation room for the care of patients including patients with infectious conditions in order to prevent the spread of aerosol infections. As later described, the first embodiment of the tier 3 may provide for negative pressure to at least one room 30.

The four patient care units 12 of the of each patient care section 4 illustrated in FIG. 1A, are separated into two patient, care subsections 24. The patient care units 12 of each subsection 24 are aligned such that a first end 32 of a first patient care unit 34 is aligned with a second end 36 of a second patient care unit 38. As noted above, the system creates a controlled environment, which is accomplished without the need for a connecting mechanism or mechanisms between the units. The alignment provides for the doors 26 of the first and second patient care units (34, 38), patient care rooms 30 of the respective patient care units (34, 38), to be on the same side, service side 103, of the patient care subsection 24. A second patient care subsection 25 is positioned at least substantially parallel to a first patient care subsection 27 along the long axis side 14 of the patient care units 12 to create the patient care section 4. The doors 26 of the respective patient care subsections (24, 25, 27) face one another and into a corridor space 40 separating the respective patient care subsections (24, 25, 27). The corridor space 40 extends at least substantially a patient care section length 50 of the patient care section 4. The corridor space 40 is the common hallway of the patient care section 4, allowing for access to the individual rooms 30. Located at least in close proximity to at least one end of the corridor, an access door 42 provides entry and exit into the corridor 40 and the patient care section 4. The patient care sections 4 are positioned with the support section between the patient care sections. An access door 42 of the corridor 40 of each patient care section 40 is in at least substantial alignment with a support unit access door 44 of the support section 6.

Figure 1B:
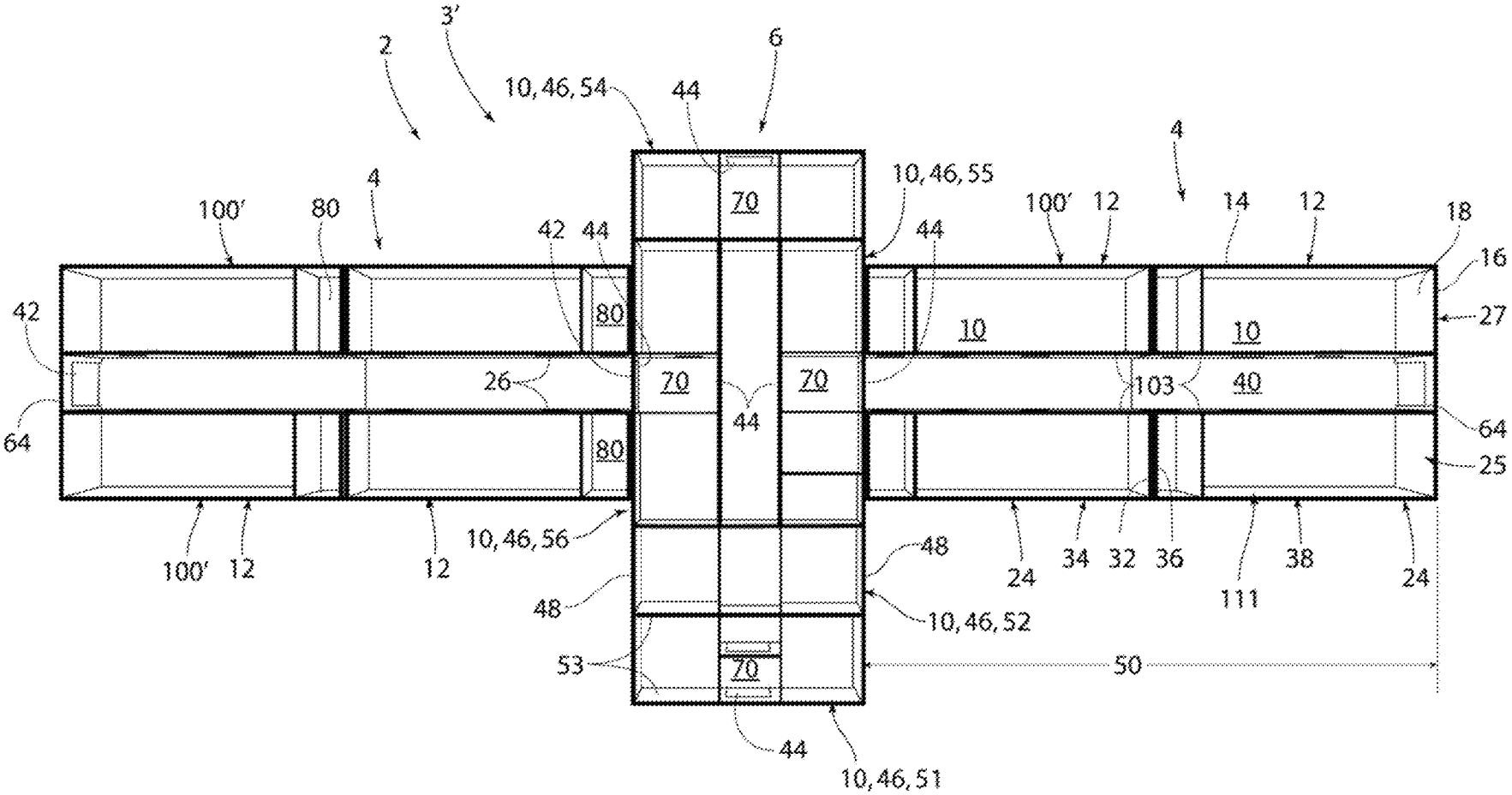
FIG. 1B is a top view of an example of a second embodiment of the tier of the modular configurable hospital system of the invention.

With attention to FIG. 1B, a second embodiment of the tier 3' of the modular configurable hospital system 2 is illustrated. The second embodiment of the tier 3' of the system 2 comprises at least one component of the first embodiment of the tier 3 of the modular configurable hospital system 2. Further, the patient are units 12 of the second embodiment of the tier—of the system 2 are a second embodiment of the patient care unit 100'. The second embodiment of the patient care unit 100' is an open ward. The second embodiment of the patient care unit 100' preferably lacks the doors 26 of the first embodiment 100. Alternatively, the second embodiment of the patient care unit 100' may have at least one door entering into the unit 100 patient ward area. As later described, the second embodiment of the tier 3' may provide for negative pressure to at least one ward 111.

Figure 1C:
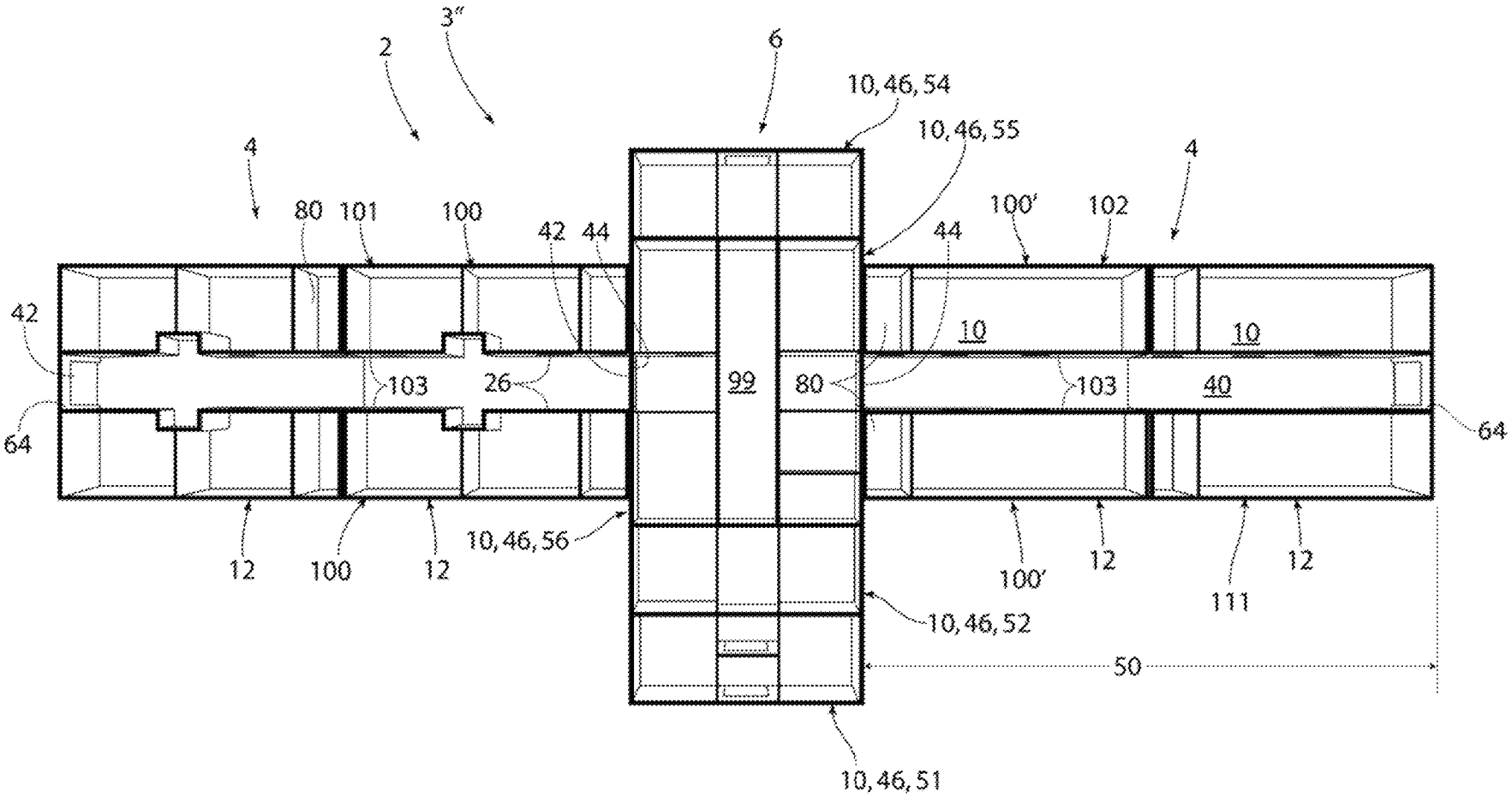
FIG. 1C is a top view of an example of a third embodiment of the tier of the modular configurable hospital system of the invention.

With attention to FIG. 1C, a third embodiment of the tier 3" of the modular configurable hospital system 2 is illustrated. The third embodiment of the tier 3" of the system 2 comprises at least one component of the first embodiment of the tier 3 of the system 2. The third embodiment of the tier 3" of the system 2 comprises at least one component of the second embodiment of the tier 3' of the system 2. Further, a first patient care section 101 of the tier 3" of the system 2 comprises at least one, preferably four, first embodiments of the patient care unit 100. A second patient care section 102 of the tier 3" of the system 2 comprises at least one, preferably four, second embodiments of the patient care unit 100'. As later described, the third embodiment of the tier 3" may provide for negative pressure to at least one of at least one ward 111 and at least one room 30.

It is understood a patient care section 4 may comprise less than four patient care units 12. It is understood a patient care section 4 may comprise more than four patient care units 12. It is understood a patient care subsection 24 may comprise one patient care unit 12. It is understood a patient care subsection 24 may comprise more than two patient care units 12. It is understood the patient care section 4 may not comprise a corridor 40. An intended benefit of this invention provides for a system 2 composed of non-common corridor/hallway area units 10.

In the examples of the tiers (3, 3', 3") of the system 2, illustrated in FIGS. 1A to 1C, the support section 6 comprises five support units 46. The description of the support units shall follow. The support units 46 of the support section 6 are oriented to any number of ways to meet the requirements presented. The orientation and attachment of the support units forms a seal between the units, further contributing to the controlled environment of the system. The support units also are connected to one another without a connection mechanism. The examples illustrated in FIGS. 1A to 1C illustrate the support section 6 comprises a support section long axis side 48 orthogonal to the long axis sides 14 of the patient care units 12. At least one support unit 46 preferably has a rectangular shape. Alternatively, at least one support unit 46 has a square shape. At least one support unit 46 comprises at least one, preferably two, support unit access doors 44. Alternatively, at least one support unit 46 may comprise less than one support unit access door 44. Preferably, the support unit access doors 44 of each support unit 46 are positioned along at least one support unit long axis side 53 of the respective support unit 46. Alternatively, the support unit access doors 44 of each support unit 46 are positioned along any side of the respective support unit 46. The access door 44 provides access into the support unit 46 or the support section 6 in general.

As illustrated in FIGS. 1A to 1C, a first support unit 51 and second support unit 52 are positioned such that the long axis sides 53 of the respective support units (51, 52) is orthogonal to the support section long axis sides 48, and parallel to one another (51, 52) and contacting one another along a long axis side 53 of each unit (51, 52). A third support unit 54 is parallel to the first and second support units (51, 52) and separated from the first and second support units (51, 52) by oppositely opposed fourth support unit 55 and fifth support unit 56. A common support area 99 is provided for by the orientation of the second 52, third 54, fourth 55 and fifth 56 support units with respect to one another.

Figure 2:
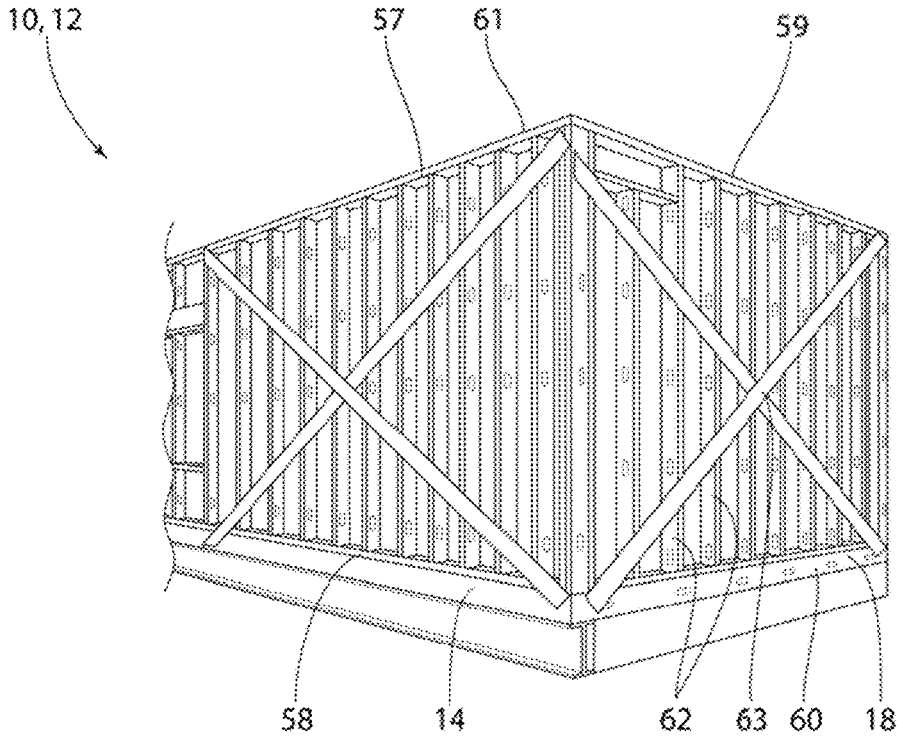
FIG. 2 is a perspective view of a unit of the system during construction of the unit.

With attention to FIG. 2, the construction of a unit 10 of the system 2 is illustrated. In particular, the construction of a patient care unit 12 is illustrated. The ends 18 and long axis sides 14 of the respective patient care unit 12 are each constructed in a framed construction 57. The framed construction illustrated in FIG. 2, provides that each respective wall (14, 18) of the unit (10, 12) comprises at least one footing member 58 at a base 60 of the unit (10,12) and at least one head member 59 at or in close proximity to a top 61 of the unit (10, 12). The foot member 58 and head member 59 are separated by and connected with at least one support beam 62 spaced at predetermined distances from one another. At least one diagonal support beam 63 may be placed in contact with the at least one beam of at least one of the respective walls (14, 18) to provide additional stability. The doors 26 are constructed within at least one wall 18 at predetermined locations. It is understood that at least one of the footing member 58, head member 59, support beam 62 and diagonal support beam 63 may be constructed of at least one of a fibrous material, such as wood, and a metallic material. It is further understood that all units 10 of the system 2 may be constructed in at least one of a similar manner and using structural components (58, 59, 62, 63) as previously described. It is understood that connection walls 64 may be constructed in at least one of a similar manner and using structural components as previously described (58, 59, 62, 63). It understood all possible construction materials and methods of structures and combinations of materials and methods may be used in the construction of the units 10 and the system 2. An intended benefit of this invention provides for a modular unit system 2 comprising units made not exclusively of metal structural beams (58, 59, 62, 63). An intended benefit of this invention provides for modular units 10 which are prefabricated and provide for an expandable system (2, 2' 2"), and configurable in any manner to meet the present demands.

Figure 3A:
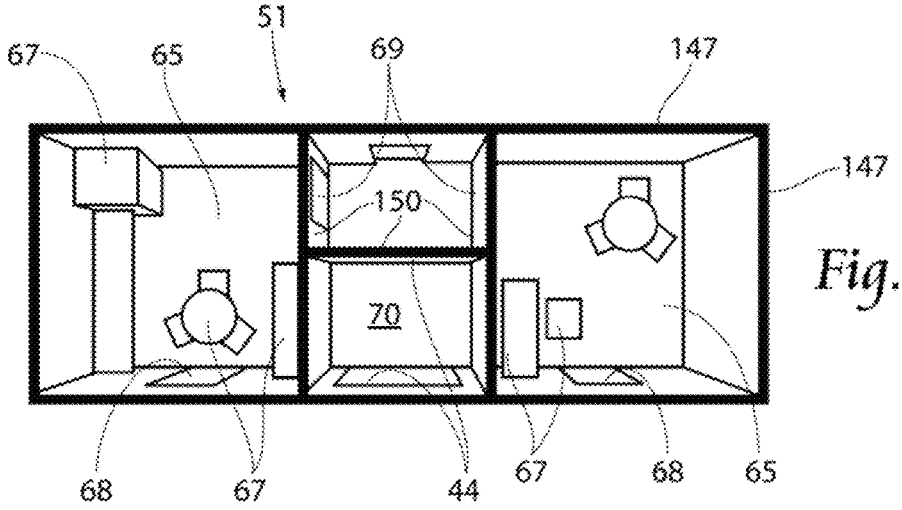
FIG. 3A is a top view of a first support unit of the system.

With attention to FIG. 3A, the first support unit 51 of the system 2 is described. The unit 51 comprises at least one preferably two office spaces 65. The offices spaces shall be furnished with various amenities 67 to assist in the functions at hand. Such amenities 67 may include cabinets, tables and chairs, and computers. The unit comprises support unit access doors 44 for access to the unit 51 as previously described. The unit 51 comprises a separation room 70 between the access doors 44 of the unit 51. The room 70 may be used as a decontamination room. Such room may be pressurized, above or below the outside environment pressure, to assist in the control of the atmosphere within the system 2 as compared to an attached patient care section 4 or the outside environment. The unit additionally comprises at least one individual access door 60 allowing for personnel to and from the outside environment. The unit 51 addition comprises internal access doors 69 for access to the various offices spaces 65 within the unit 51.

Figure 3B:
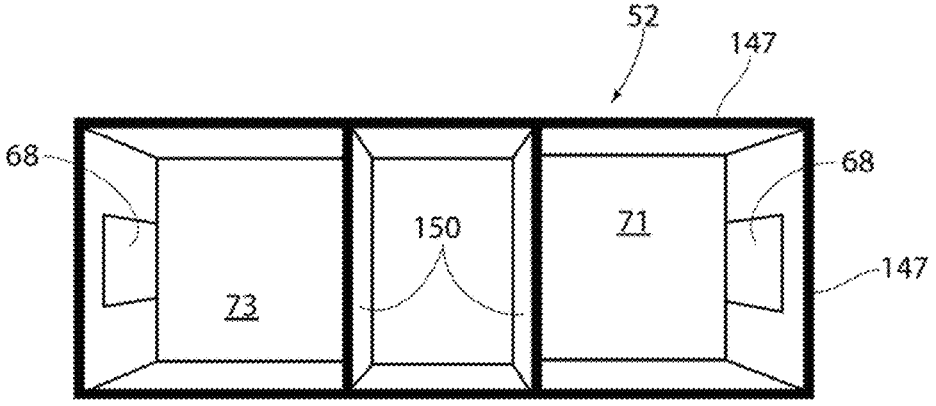
FIG. 3B is a top view of a second support unit of the system.

With attention to FIG. 3B, the second support unit 52 of the system 2 is described. The unit 52 comprises at least one communications room 73 for housing hardware and software for the communications structure of the system 2. The unit 52 comprises at least one electrical room 71 for housing the electrical framework of the system 2. The unit additionally comprises at least one individual access door 68 allowing for personnel to and from the outside environment. In FIG. 3B, each of the communications room 73 and the electrical room 71 is provided with an individual access door 68. The unit 52 may be provided with access doors 44.

Figure 3C:
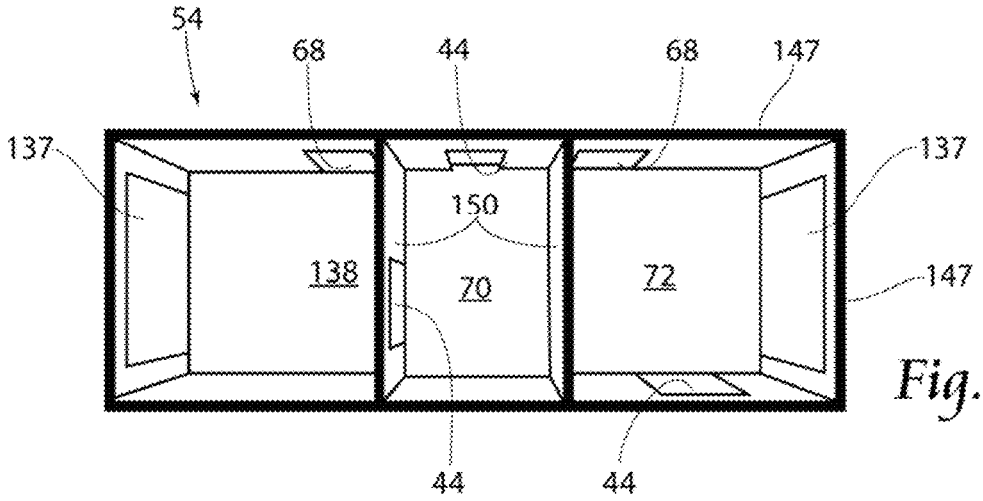
FIG. 3C is a top view of a third support unit of the system.

With attention to FIG. 3C, the third support unit 54 of the system 2 is described. The unit 54 comprises a clean loading dock 72 with a maintenance access door 137. The clean loading dock 72 provides for entry of materials and equipment into the system 2. The unit 54 provides for a waste removal dock 138 with an access door 137, for removal of waste from the system 2. It is important to note that personnel and staff are unable to transfer between the docks 72, 138) of the unit 54 for sanitary and contamination prevention purposes. The waste removal dock 138 comprises a door 44 as previously described which enters at least one separation room 70 positioned between the docks (72, 138). As illustrated, at least one of the docks (72, 138) comprises a door 68, as previously described, for access of the respective dock (72, 138) to at least one of the exterior of the respective tier (3, 3', 3") or the system 2. The unit comprises second door 44, allowing access into the room 70 of the unit 54 from outside the unit 54. The unit further comprises at least a second door 44 allowing access between the clean loading dock 72 and at least one of a neighboring unit (10, 46) and the exterior.

Figure 3D:
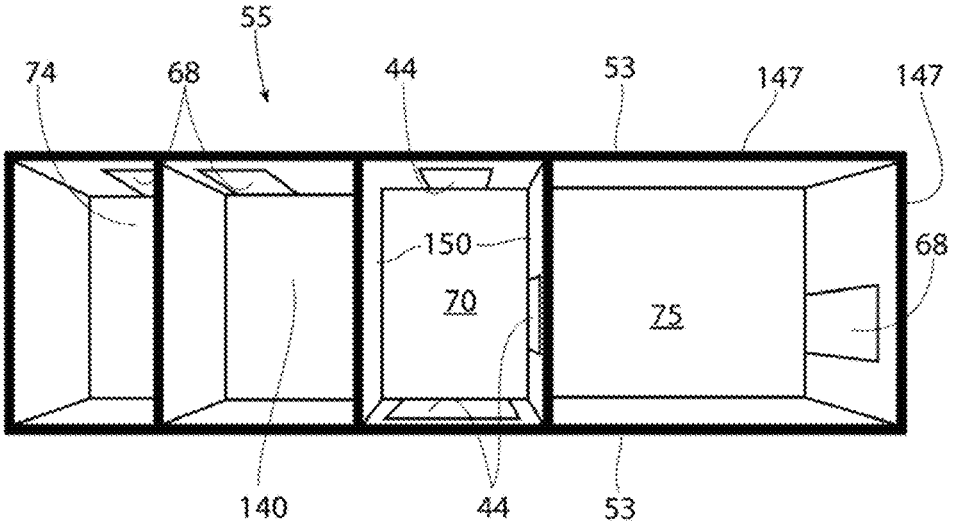
FIG. 3D is a top view of a fourth support unit of the system.

With attention to FIG. 3D, the fourth support unit 55 of the system 2 is described. The unit 55 comprises at least one all-purpose room 75. The room 75 may be used for storage, meetings, sleeping quarters, a computer room, a lab, or any purpose required for the function of the system. The unit 55 comprises at least one separation room 70. Alternatively, the unit 55 has no separation room 70. The unit 55 provides at least one, preferably two, doors 44 into the unit 55, preferably the separation room 70. Preferably the two access doors 44 are along the support unit long axis sides 53 of the unit 55. The unit further provides a door 44 from the separation room 70 into the all-purpose room 75. The unit 55 further provides for at least one food preparation room 74 for preparation of food and nutrition for patients. The unit 55 further provides for at least one medication storage 140 for preparation of food and nutrition for patients. The rooms (74, 140) have individual access doors 68 for accessing the rooms (74, 140).

Figure 3E:
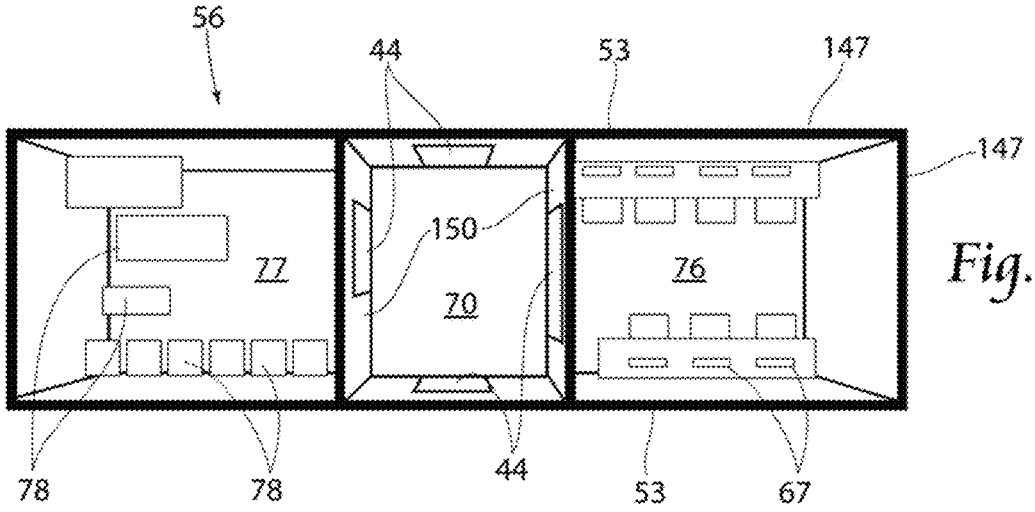
FIG. 3E is a top view of a fifth support unit of the system.

With attention to FIG. 3E, the fifth support unit 56 of the system 2 is described. The unit 56 comprises at least one computer room 76. The computer room may house amenities 67, as previously described, and include computers for use by the staff and providers within the system 2. Alternatively, the unit 56 does not comprise the computer room 76. The unit 56 further comprises at least one therapy equipment storage room 77. The therapy equipment storage room 77 may comprise at least one item of therapy equipment 78 for use by staff and operators within the system 2. Alternatively, the unit 56 does not comprise the therapy equipment storage room 77. The unit 56 may comprise at least one separation room 70. The unit 56 provides at least one, preferably two, doors 44 into the unit 56, preferably the separation room 70. Preferably, the two access doors 44 are along the support unit long axis sides 53 of the unit 55. Alternatively, the doors 44 into the unit 55 may be along any wall of the unit 55. As illustrated in FIG. 3E, the unit 56 provides for access doors 44 from the separation room 70 into at least one of computer room 76 and the therapy equipment storage room 77.

It is understood that any room (65, 71, 73, 72, 74, 75, 76, 77, 70, 138, 140) in any of the support units (51, 52, 54, 55, 56) may provide for any component, and be used for any of the functions, of any room (65, 71, 73, 72, 74, 75, 76, 77, 70, 138, 140) in any of the support units (51, 52, 54, 55, 56) as previously described.

It is understood that any door (44, 68, 69) may comprise any components of any door (44, 66, 69).

It is understood that any room (65, 71, 73, 72, 74, 75, 76, 77, 70, 138, 140) of any support unit (51, 52, 54, 55, 56) may comprise at least one any combination of any door (44, 68, 69) and open access way along any internal wall 150 defining the respective room (65, 71, 73, 72, 74, 75, 76, 77, 70, 138, 140) and any boundary wall 147 defining the respective room (65, 71, 73, 72, 74, 75, 76, 77, 70, 138, 140) of any support unit (51, 52, 54, 55, 56).

Figure 4A:
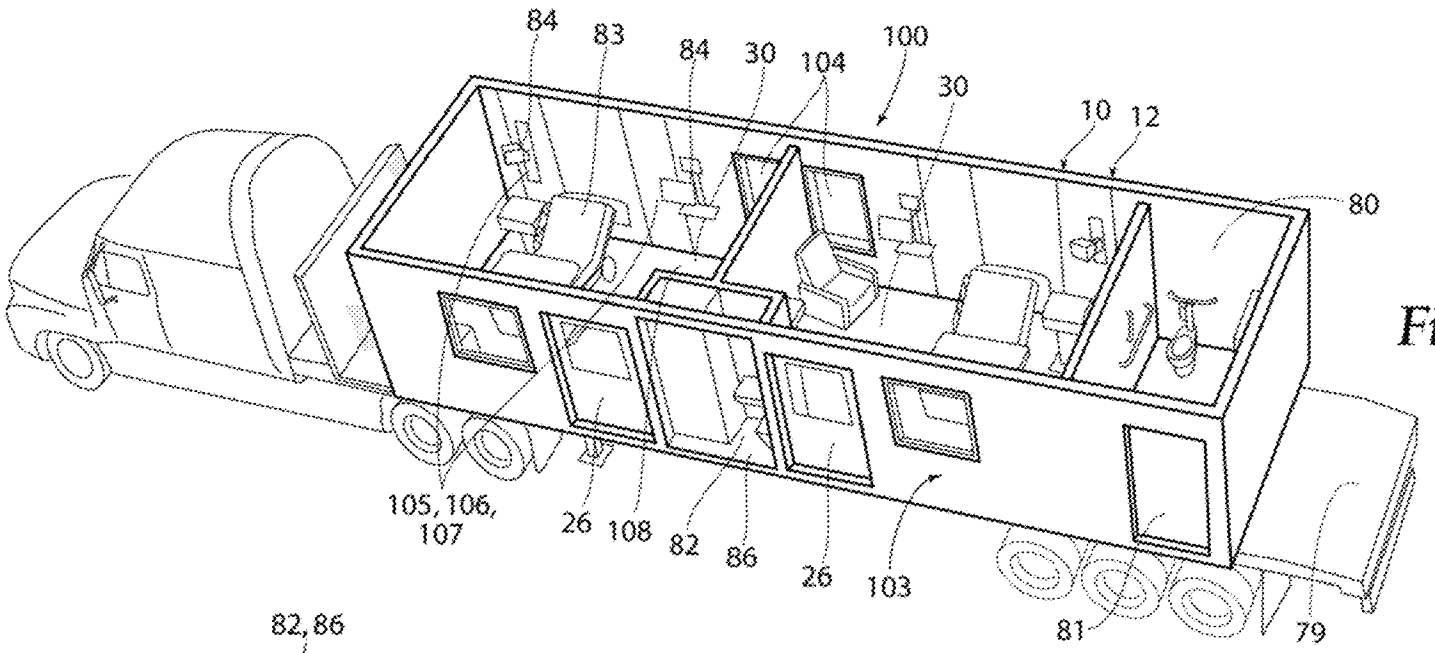
FIG. 4A is a perspective view of a first embodiment of the patient care unit of the system, illustrating transporting the patient care unit on a tractor-trailer flatbed.

With attention to FIG. 4A, a first embodiment of the patient care unit 100 of the system 2 is illustrated. The patient care unit (12, 100, 100') of the system 2 may be transported on a tractor-trailer flatbed 79 to a request location. Where required, the unit 12 may be employed on the tractor trailer flatbed 79. Further, all units 10 of the system 2, including support units 46, may be at least one of transported and employed on tractor-trailer flatbeds 79. Alternatively, the units 10 of the system 2 may be transported using at least one of airplanes, ships, helicopters, and the tractor-trailer flatbed 79. An intended benefit of the invention provides for a modular unit system 2 comprising units 10 which are transportable upon a tractor-trailer flatbed 79.

Figure 4B:
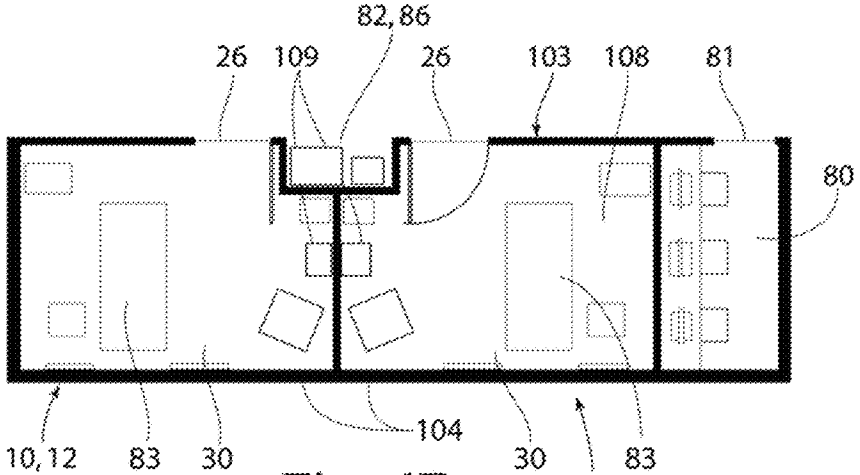
FIG. 4B is a top view of a first embodiment of the patient care unit of the system with a computer room.

As illustrated in FIGS. 4A and 4B, a first embodiment patient care unit 100 may comprise at least one, preferably two, patient rooms 30. At least one patient room 30 of the unit 12 provides for at least one patient resting surface, or bed, 83. As illustrated in FIG. 4A, at least one patient room 30 may provide for an exterior window 104. The exterior window 104 provides a calming feature for workers and patients, and to provide patients the ability to communicate with family members and friends. At least one patient room 30 of the unit (12, 100) provides for at least one item of patient care machinery 84. The patient rooms 30 may provide for access 105 to gas mixtures for ventilators. Such access 105 may be on the at least on wall of the room 30. The rooms 30 may provide vital sign connections 106. Such vital sign connections 106 may be for at least one of cardiac monitoring, and other vital aspect monitoring. The connections may be located along at least one wall of the room 30. The rooms 30 may provide for respiratory treatment ports 107 along at least one wall of the room 30. As illustrated in FIGS. 4A and 4B, the rooms 30 have sufficient floor space 108 for medical equipment, for example x-ray machines, and the patient beds to be maneuvered and for patient transfers. The floor space 108 additionally allows for access and maneuverability of supply carts within the room 30. As illustrated in FIG. 4B, the room 30 may provide for at least one doffing zone 109. The doffing zone 103 may provide an area for disposal of personal protective equipment after care of the patient within the room 30, and handwashing before leaving the room 30. Further, as illustrated in FIG. 7, at least one unit (10, 12, 100) is negatively pressurized, 96, promoting retention of contagions within the specific patient room 30.

As illustrated in FIGS. 4A and 4B, along at least one long axis side 14 of the unit (12, 100) preferably the service side 103, a service alcove 82 may be provided. Such alcove 82 provides additional serviceable floor space 86 outside the patient rooms 30. The alcove 82 may provide for a donning station 116 for preparation to enter a room 30, including hand washing and donning personal protective equipment. Additionally, along the service side 103 of the unit (12, 100), a viewing window 110 may be provided for at least one room 30 of the unit (12, 100). The viewing window 110 allows for monitoring of the patient without placing the healthcare workers at continued risk. An intended benefit of this invention provides for immediate access to personal protection features at the patient care unit.

As illustrated in FIGS. 4A and 48, the unit (12, 100) may comprise at least one service room 80 having a service room access door 81 along at least one long axis side 14, preferably the service side 103. As illustrated in FIGS. 1A-1C and FIGS. 4A and 4B, the service room 80—may be at least one of a bathroom, a computer room, and a therapy service room for maintenance of patient rooms 30 and/or beds 83.

Figure 4C:
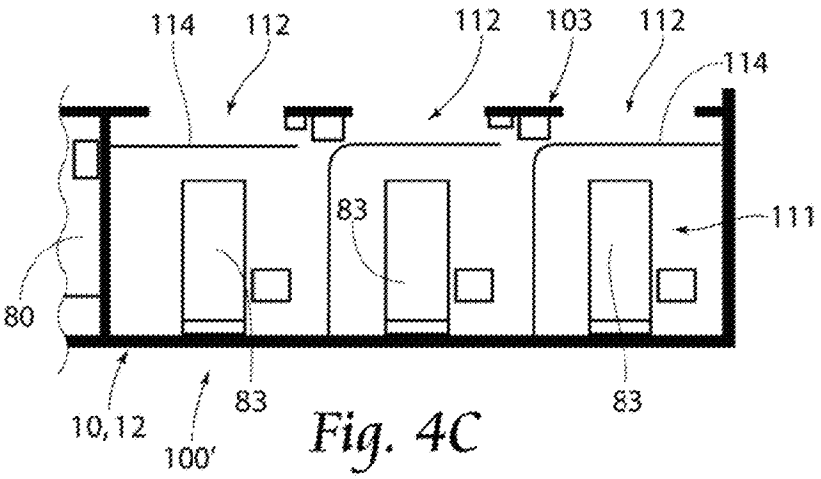
FIG. 4C is a top view of a second embodiment of the patient care unit of the system.

With attention to FIG. 4C, the second embodiment of the patient care unit 100' of the system 2 is described. It is understood the second embodiment of the patient care unit 100' may comprise at least one feature of the first embodiment of the patient care unit 100. It is understood the first embodiment of the patient care unit 100 may comprise at least one feature of the second embodiment of the patient care unit 100'. The second embodiment of the patient acre unit 100' is a patient ward 111. The patient ward 11 comprises at least one, preferably three, beds 83. As stated earlier, the second embodiment of the patient unit 100' preferably does not provide for access doors to the beds 83. Preferably, the second embodiment of the patient unit 100' provides for open walkways 112 into the ward 111. At least one bed 83 may be provided with a retractable screen unit 114 to provide privacy to the patient occupying the respective bed 83.

It is understood that each unit (10, 12) may be a standalone unit (10, 12) with all the required features for patient therapy.

Figure 5:
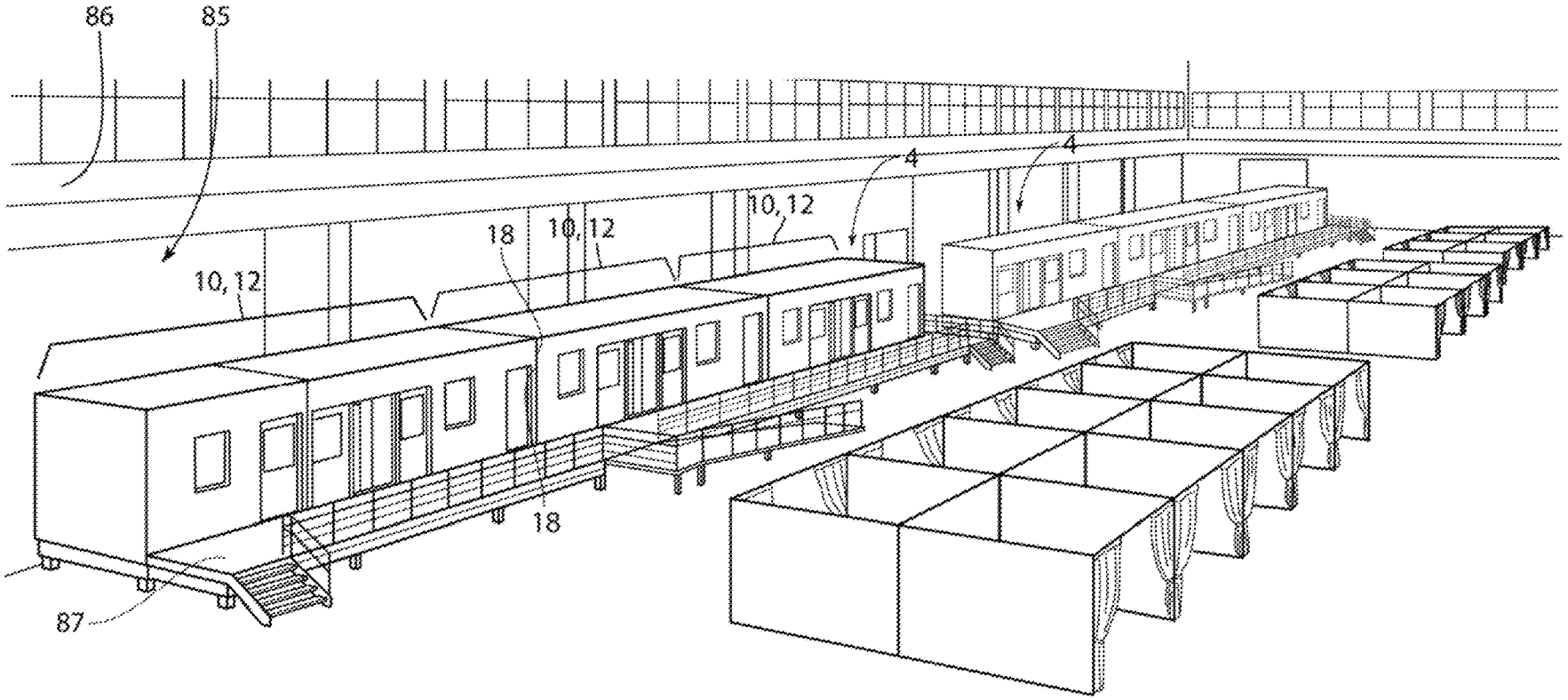
FIG. 5 is a perspective view of a first orientation of the system positioned within a large covered facility.

With attention to FIG. 5, a first orientation of the system 2 positioned within a large covered facility or building 86. The system 2 may be positioned within an internal space 85 of a building 86. The units (10, 12) may be positioned end 18 to end 18. The system 2 can be arranged without a corridor 40. Instead, patient care sections 4 may be accessed using access ways 87. Further, patient care sections 4 may be positioned in any manner with respect to on another. Additionally, support sections 6 may be positioned away from the patient care sections 4, or not employed. An intended benefit of this invention provides for separate patient care units 10 to be attached end 18 to end 18.

Figure 6A:
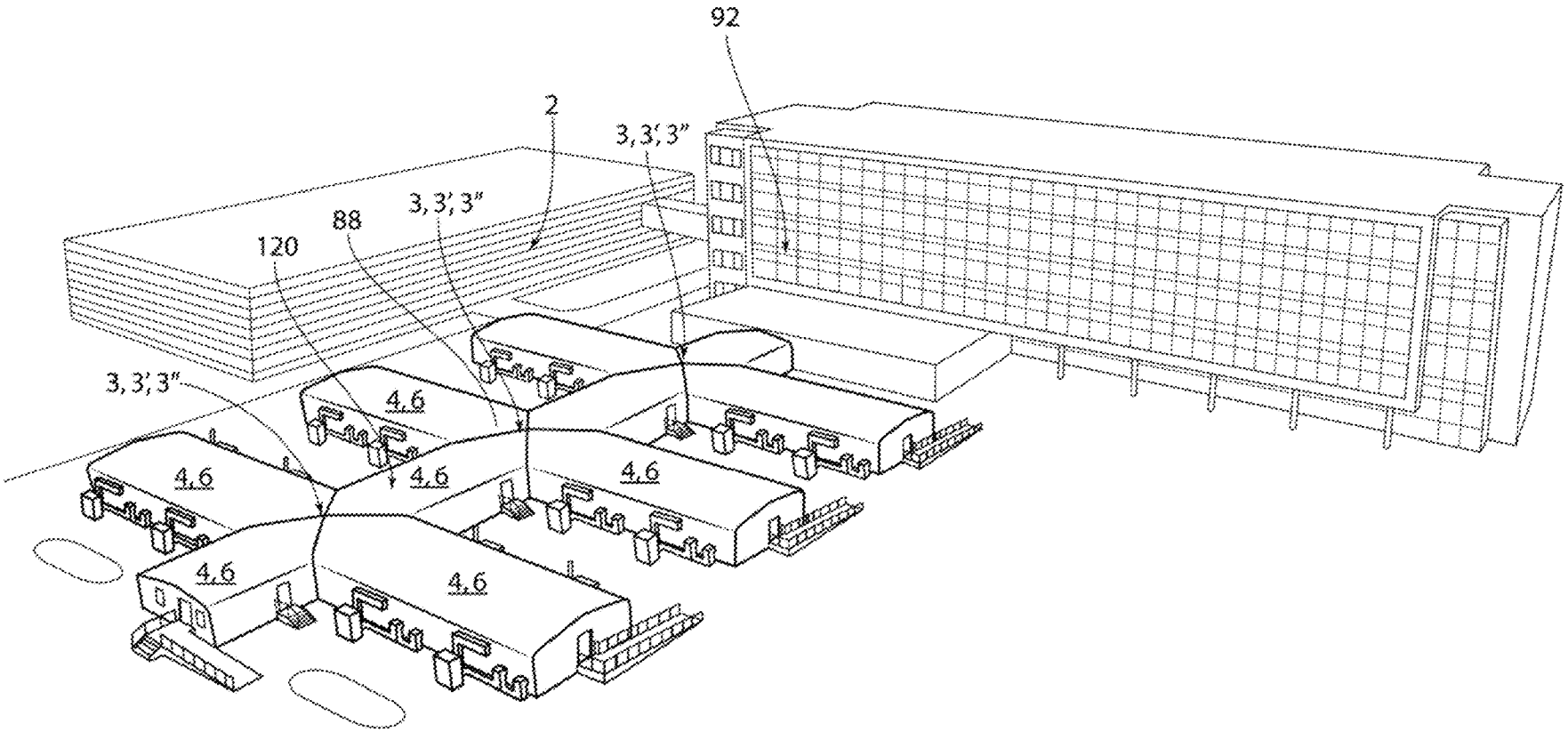
FIG. 6A is a perspective view of a second orientation of the system positioned in the open environment, illustrating three tiers.

With attention to FIG. 6A, a second orientation of the system 2 is illustrated as positioned in the open environment, illustrating three tiers (3, 3', 3"). A roof 88 may be placed over the system 2, or part of the system 2. As illustrated in FIG. 6A, a system orientation may provide for multiple tiers (3, 3', 3"), for example three tiers (3, 3', 3"), positioned in alignment. Further, as illustrated in FIG. 6, the system may be attached to another facility 92, for example a hospital infrastructure.

Figure 6B:
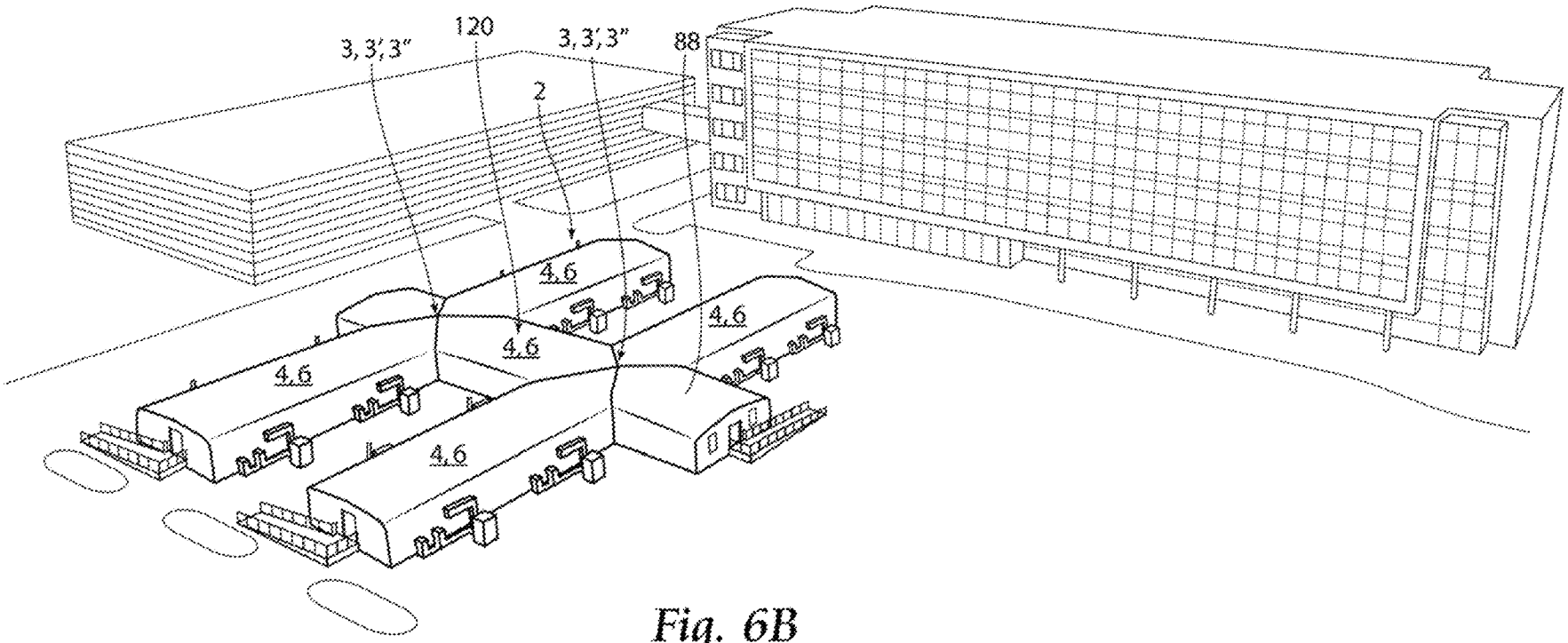
FIG. 6B is a perspective view of a third orientation of the system positioned in the open environment, illustrating two tiers.
Figure 6C:
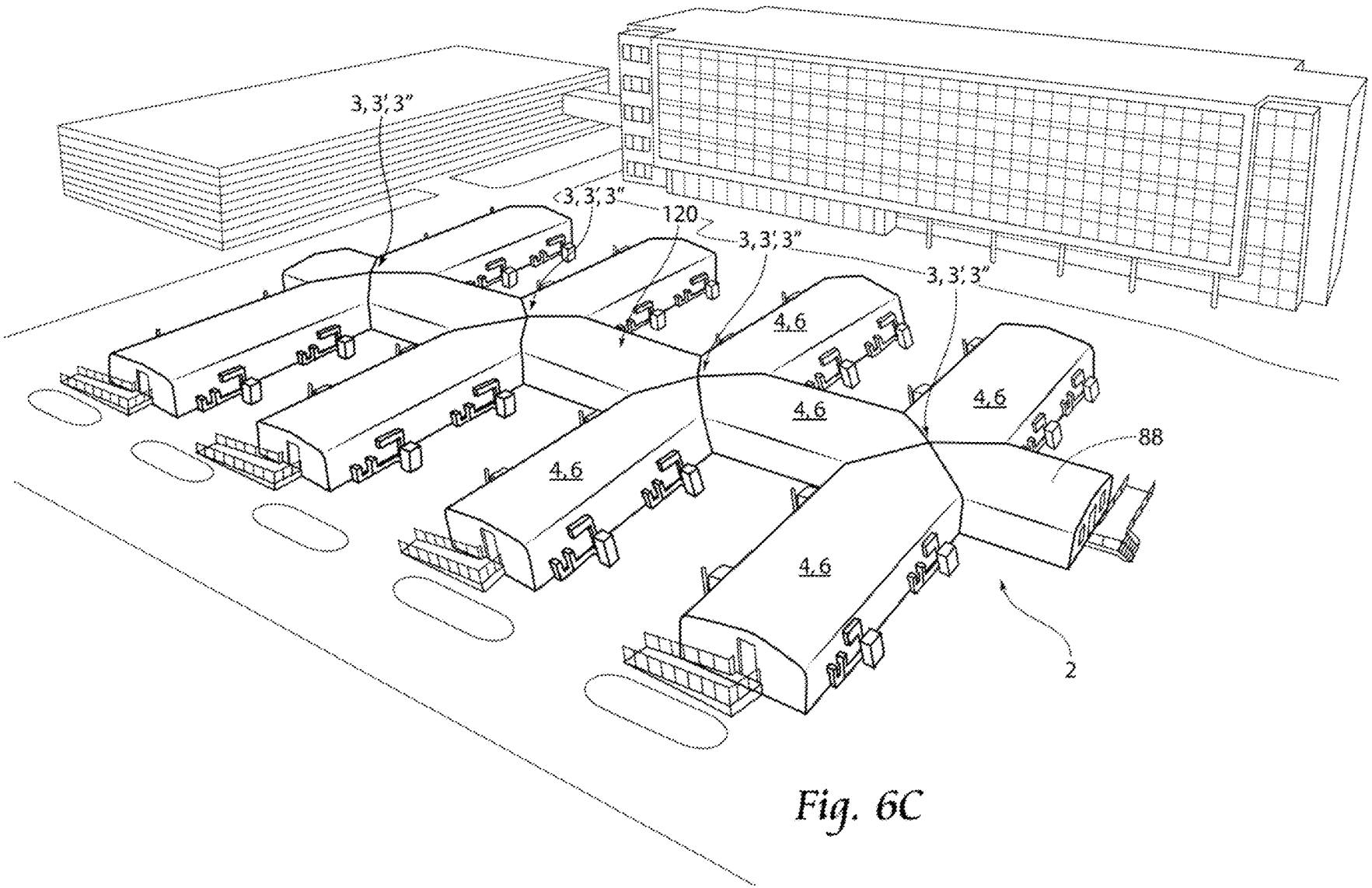
FIG. 6C is a perspective view of a fourth orientation of the system positioned in the open environment, illustrating four tiers.

With attention to FIGS. 68 and 6C, alternatively, the system 2 may be stand alone. The orientations in FIGS. 6B and 6C illustrate the system 2 may be a self-sufficient standalone hospital with infrastructure to support the system 2. As illustrated in FIG. 6B, a third orientation of the system is positioned in the open environment with two tiers (3, 3', 3"). As illustrated in FIG. 6C, a fourth orientation of the system positioned in the open environment with four tiers (3, 3', 3").

It is understood the system 2 may be positioned in both indoor environment, as illustrated in FIG. 5, outdoor environments, as illustrated in FIGS. 6A-6C, and a combination of indoor and outdoor environments. It is understood the system 2 may have more than four tiers (3, 3', 3"). Further, it is understood the orientation of the system 2 is not limited by attachment mechanisms mating individual units 10 together or sections (4, 6) with one another. The individual units (10) may be attached or in close proximity to one another. The respective sections (4, 6) may be attached or in close proximity to one another. With that, it is understood the features of the system 2 may be placed in any number of orientations. Any orientation of the system 2, whether illustrated or not, may comprise a feature of another orientation of the system 2. Thus, the orientation of the system 2 is not limited of units 10 and sections (4, 6), and may be according to the demands, space, and logistics at hand. An intended benefit of this invention provides for combining the units 10 and tiers (3, 3', 3") in a manner not limited by the mechanism for combining the units 10 and tiers (3, 3', 3").

Figure 7A:
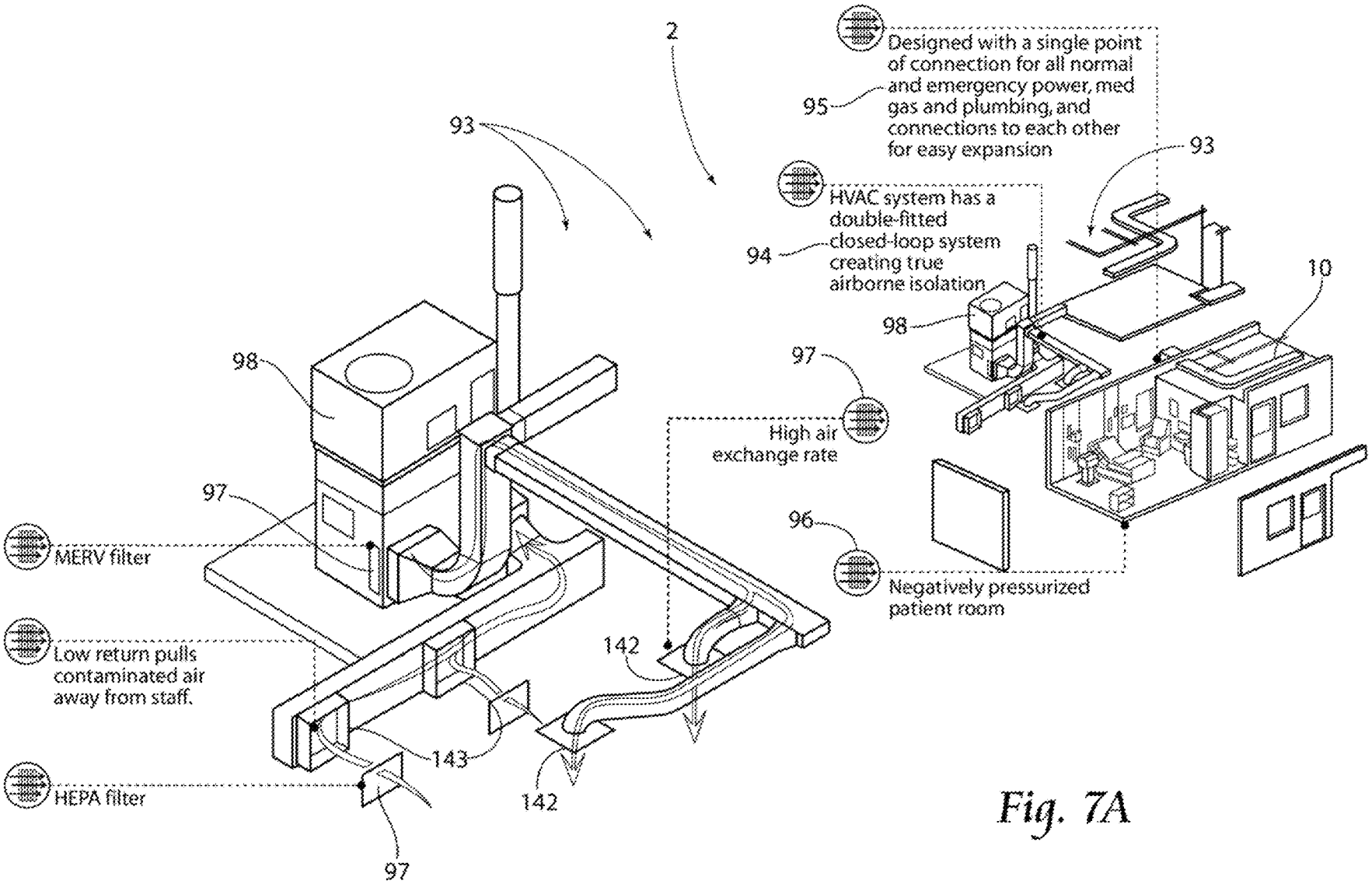
FIG. 7A is a perspective view of the heating, ventilation and air condition plant of the system.

With attention to FIG. 7A, a heating, ventilation and air condition (HVAC) system 93 of the modular configurable hospital system 2 is described. The HVAC system 93 is a constant flow system, allowing for continuous operation upon installation. The HVAC system 93 may be a double closed loop filter system 94. Alternatively, the HVAC system 93 may be any system known in the industry. The HVAC system 93 has at least one point of contact with the at least one unit 10, 95. At least one unit 10 is negatively pressurized, 96. Alternatively, no units are negatively pressurized. The HVAC system 93 provides for a rate of air exchange. Preferably, the HVAC system 93 provides for a high rate of air exchange. The HVAC system 93 provides for at least one filter 97. Preferably, the HVAC system 93 provides for at least one filter 97, for example a HEPA filter, located at one or multiple units 10. Additionally, the HVAC system 93 provides for at least one filter 97, for example a MERV filter, at a central unit 98 of the system 93. The HVAC system 93 thus provides for efficient exchange of air within at least one unit 10. Additionally, the filters 97 reduce cross contamination between units 10.

Figure 7B:
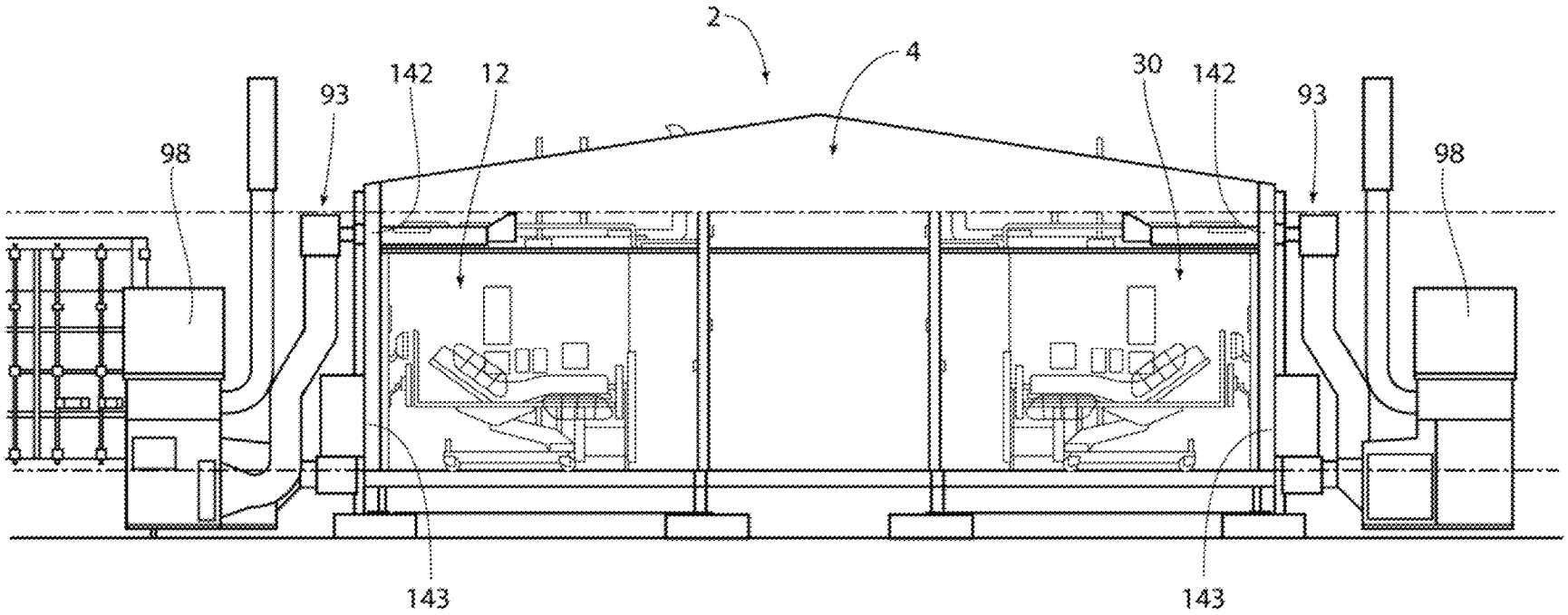
FIG. 7B is a cross-section of the patient care unit of the system, illustrating connection of the heating, ventilation and air condition plant of the system with a patient care section of the system.

As illustrated in FIGS. 7A and 7B, at least one HVAC system 93, and the associated central unit 98, is connected to a patient care section 4 at one or more air input locations 142 and a corresponding air return 143. The air return 143 preferably being a low air return. As illustrated in FIG. 7B, the combination of the air input location 142 and the corresponding low air return provides for negative pressurization of at least one of a patient 30 and a patient care unit 12.

Figure 8A:
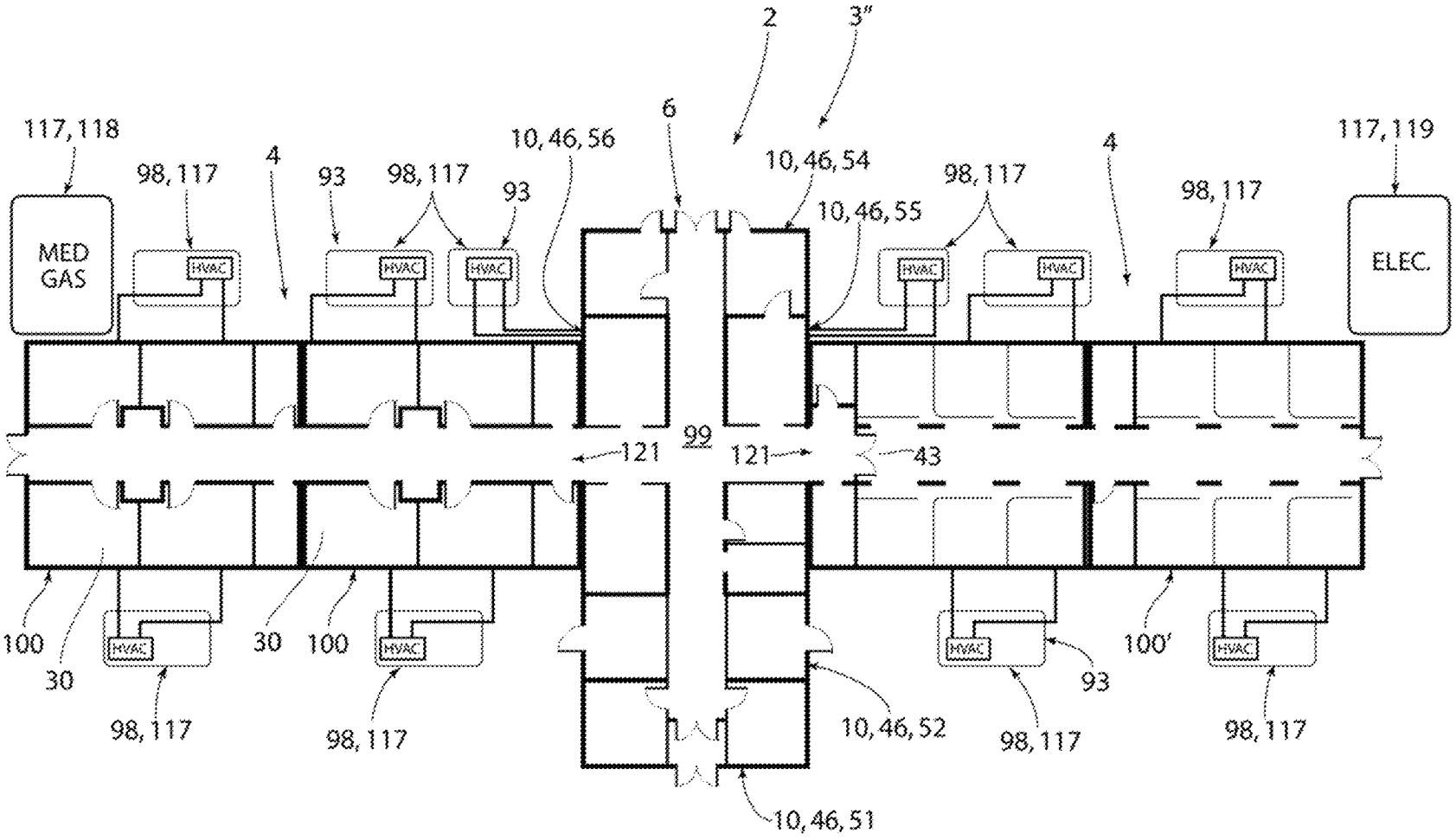
FIG. 8A is a top view of the third embodiment of the tire of the system, illustrating locations of support systems.
Figure 8B:
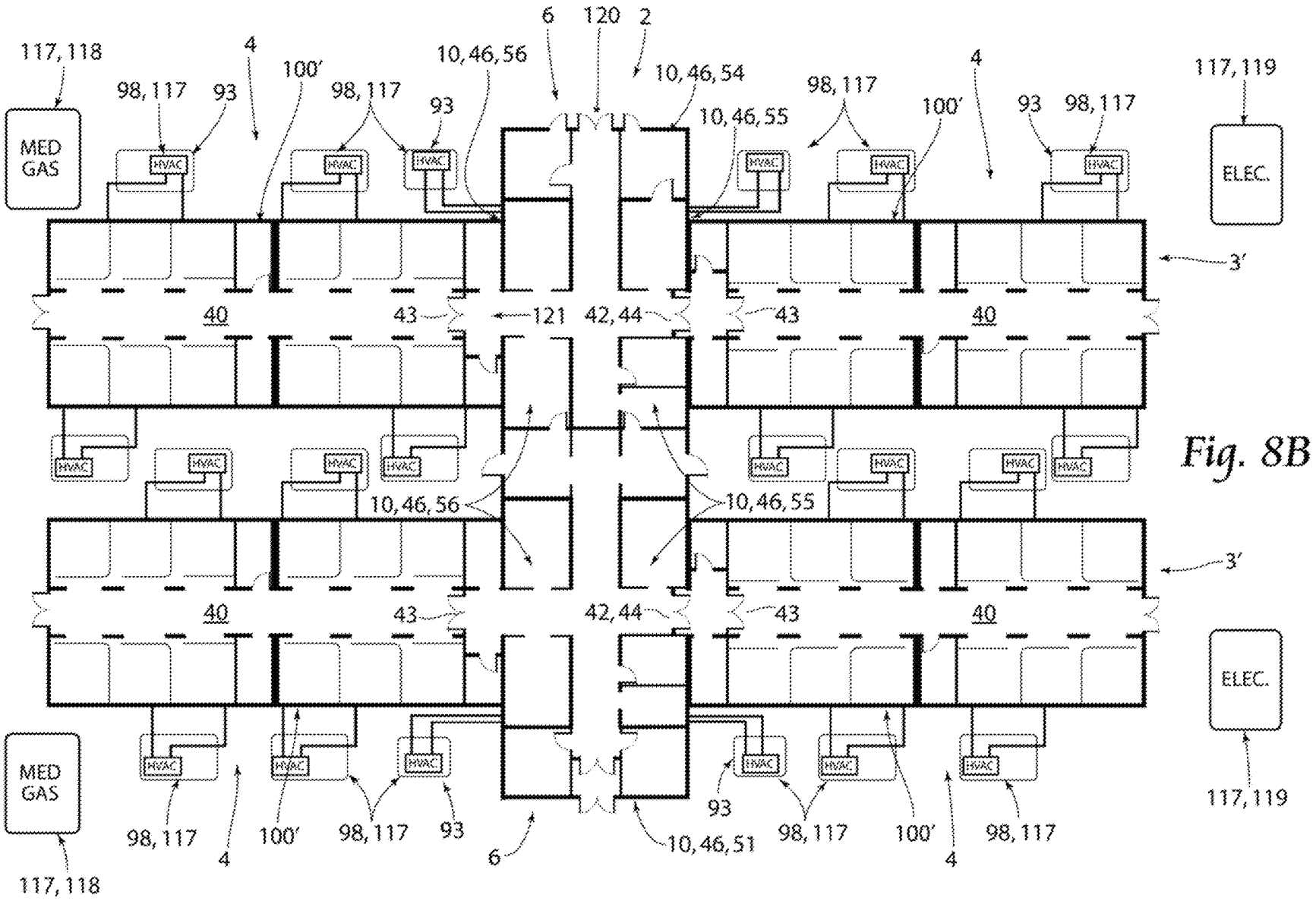
FIG. 8B is a top view of the two second embodiments of the tier of the system in communication with one another, illustrating locations of support systems.

With attention to FIGS. 8A and 8B, locations of support systems 117 for the modular configurable hospital system 2 are described. Support systems 2 comprise, but are not limited to, HVAC systems 93, medical gas 118, and electrical systems 119. Additionally, it is understood each tier (3, 3', 3") may include at least one of power generators, supply water, and a holding tank for sanitary purposes. FIG. 8A illustrates the third embodiment of the tier 3" of the system 2. Both the medical gas storage (117, 118) and electrical systems (117, 119) are positioned in close proximity to the tier 3" of the system 2 that the medical gas storage (117, 118) and the electrical system (117, 119) supports. Each patient care unit (12, 100, 100') is connected to the HVAC system 93 and a central unit 98 of the respective HAVC system 93. Thus, each patient care unit (12, 100, 100') is supported by an HVAC system 93, providing circulated air and potentially a negative pressure environment within the unit (12, 100, 100'), or individual rooms of the unit (12, 100, 100'). FIG. 8B illustrates two second embodiments of the tier 100' of the system 2 in communication with one another at the support sections 6, forming a combined support unit 120, and in the third orientation of the system. The support sections of each tier 3' comprise the at least one of the fourth support unit (10, 46, 55) and the fifth support unit (10, 46, 56) in communication with each of the patient sections 4 of the tier 3'. The first support unit (10, 46, 51) and the third support unit (10, 46, 54) are positioned at opposite ends of the combined support section 120. The second support unit is positioned approximately half way between the first support unit (10, 46, 51) and the third support unit (10, 46, 54) along the combined support section 120. As illustrated in FIG. 8A, in FIG. 8B each patient care unit (12, 100') is connected to a central unit 98 and the HVAC system 93 of the respective central unit 98. Thus, each patient care unit (12, 100') is supported by an HVAC system 93, providing circulated air and potentially a negative pressure environment within the unit (12, 100)'.

Figure 10:
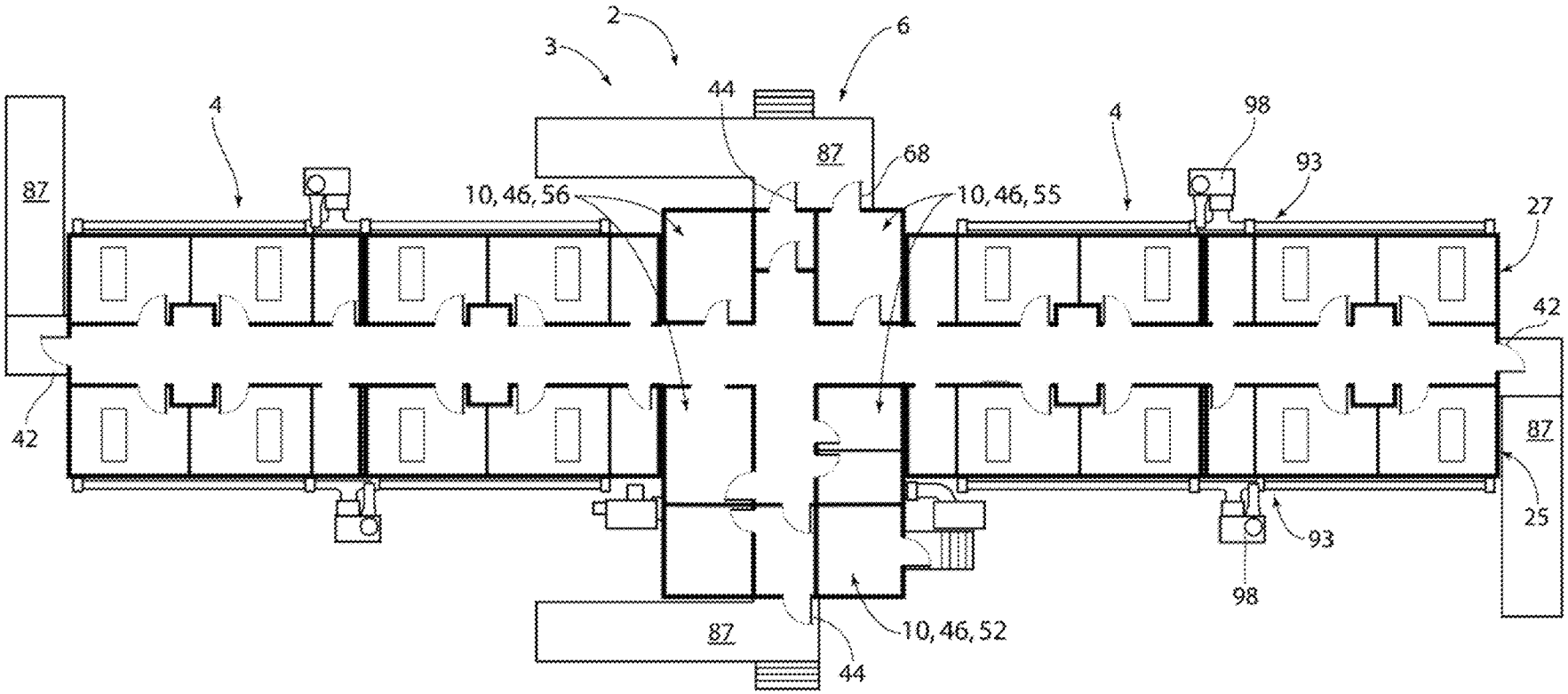
FIG. 10 is a top view of a fifth orientation of the system.

Alternatively, more than one patient care unit (12, 100, 100') make be supported by one HVAC system 93 and the corresponding central unit 98. Alternatively, as illustrated in FIG. 10, each patient car subsection (25, 27) of a respective patient care unit 4 is supported by one HVAC system 93, and the associated central unit 98, as previously described. As illustrated in FIG. 8B, the support section 6 of each tier 3' is connected to two HVAC systems 93.

As illustrated in FIGS. 8A and 8B, at least one patient care section entry way 121 from the support section 6 of a tier (3, 3', 3") to a patient section 4 of the tier (3, 3', 3") may not comprises an access door (42, 44). Alternatively, the at least one patient care section entry way 121 from the support section 6 of a tier (3, 3', 3") to a patient section 4 of the tier (3, 3', 3") may comprise an access door (42, 44). Alternatively, in close proximity to a respective entryway 121 between a support section 6 and a patient care section 4, within the corridor space 40 of the respective patient care section 4, a recessed corridor door 43 may be positioned, without an access door (42, 44) positioned at the entryway 121. Alternatively, in close proximity to a respective entryway 121 between a support section 6 and a patient care section 4, within the corridor space 40 of the respective patient care section 4, a recessed corridor door 43 may be positioned, and an access door (42, 44) is additionally positioned at the respective entryway 121. It is understood at least one recessed corridor access door 43 may comprise at least one feature of the access door 42, and at least one access door 42 may comprise one feature of the corridor access door 43. It is understood at least one corridor access door 43 may comprise at least one feature of the door 44, and at least one door 44 may comprise one feature of the corridor access door 43.

Figure 9A:
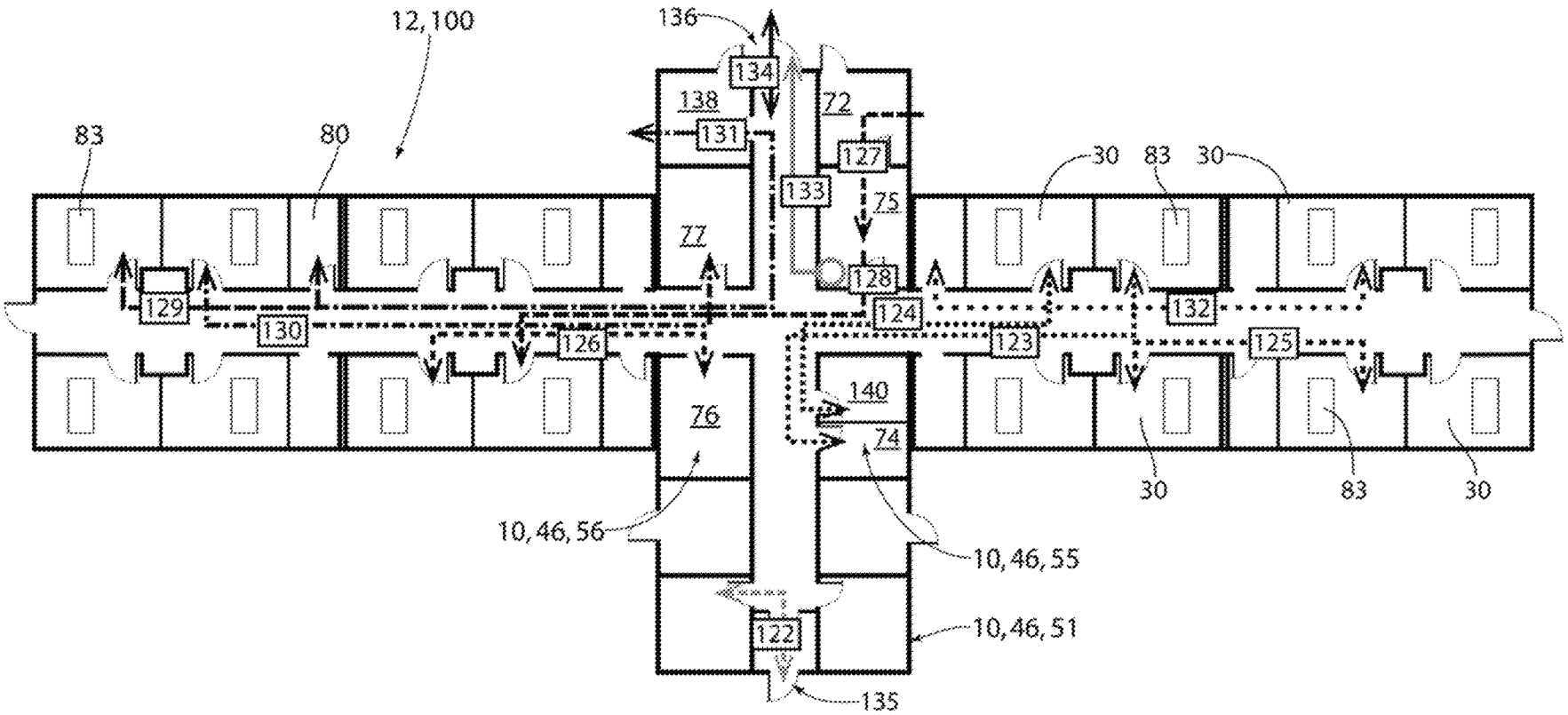
FIG. 9A is a method of operating a first embodiment of the invention.

FIG. 9A is a method of operating the system 2 comprising one tier (3, 3', 3"). Initially, standalone units, patient and/or support, are provided and transported to a location for combining the units into a system. The units are attached to one another, as previously described. The attachments of the units create seals that provide for controlled environment of the system, as previously referenced. Staff and healthcare personnel enter into and out of the tier (3, 3', 3"), system 2 at a designated staff/healthcare personnel access location 135, preferably in a support unit (10, 46), 122. As illustrated in FIG. 9A, the access location 135 is at the first support unit (10, 46, 51). Staff and personnel transfer food and/or nutrition from the food preparation room 74 to the specific patient room 30 or bed 83, 123. Staff and personnel transfer medication from medication storage 140 to the specific patient room 30 or bed 83, 124. As illustrated in FIG. 9A, the medication storage 140 and food preparation room 74 are located in the fourth support unit (10, 46, 55) of each tier (3, 3', 3"). Registered nurses monitor patients in separate rooms 30 and or beds 83, 125. Staff and personnel move between the patient room 30 or bed 83 and the computer room 76, 126. As illustrated in FIG. 9A, the computer is located in the fifth support unit (10, 46, 56) of each tier (3, 3', 3"). Materials and equipment entering the system 2 enter into the clean loading dock 72 and are stored in the all-purpose room 75 of each tier (3, 3', 3") or other rooms of the system 2, 127. Equipment and materials are transferred from the all-purpose room 75, or other room of the system, to the specific patient room 30 or bed 83, 128. Where a bed 83 is soiled or the coverings of the bed 83 are dirty in another manner, the coverings are transferred to the service room 80 of the respective patient care unit (12, 100, 100'), 129. Therapy equipment is transferred to a specific patient room 30 or bed 83 from the therapy equipment storage room 77 of the tier (3, 3', 3"), 130. Waste accumulated in the system 2 from at least one of the patient room 30, a specific bed 83, the service room 80 and other rooms of the system 2 is transferred out of the system 2 through the waste removal dock 138, 131. Patients who are ambulatory or mobile may use the bathrooms provided in at least one service room 8 of the respective patient care section 4, 132. Blood samples taken of patients in the system are transferred out of the system 2 from a utility access point 136, 133. Emergency medical service (EMS) access the system through the utility access point 136 to provide emergency services to patients and/or remove patients from the system 2, 134.

Figure 9B:
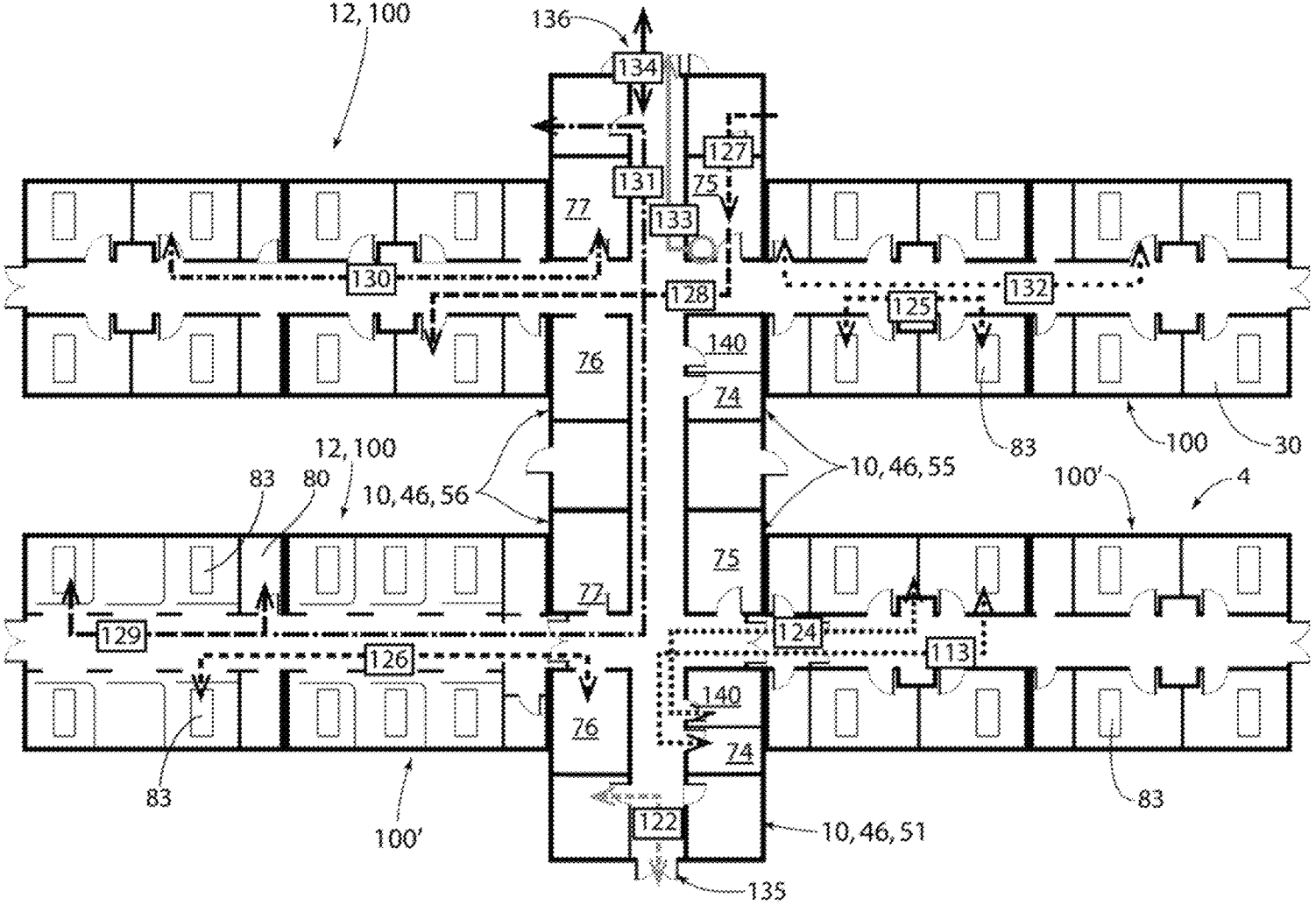
FIG. 9B is a method of operating a system comprising a first embodiment of the invention and a second embodiment of the invention.

FIG. 9B illustrates the method of operating the system 2 applied to the system 2 comprising two tiers (3, 3', 3"), specifically the first embodiment of the tier 3 and the second embodiment of the 3'. It is understood the method of operation as described in FIG. 9A, which depicts one tier (3, 3', 3"), applies to systems comprising more than one tier (3, 3', 3"), as illustrated in FIG. 9B. It is understood that operations for a patient in a specific tier (3, 3', 3") sourced at fourth support unit (10, 46, 55) and the fifth support unit (10, 46, 56) will come from the respective fourth support unit (10, 46, 55) and the fifth support unit (10, 46, 56) of that specific tier (3, 3'3 3") where possible but may come from a different tier (3, 3', 3"). It is understood the method operation applies to any tier (3, 3', 3") and any orientation of the system 2. An intended benefit of this invention provides for a method of operation ensuring efficient and safe operation of the system 2.

With attention to FIG. 10, a fifth orientation of the system 2. As illustrated in FIG. 10, the system 2 may be oriented to comprise the first embodiment of the tier 3 where two support units 46 are removed. The fifth orientation provides for use of the fourth support unit (10, 46, 55), the fifth support unit (10, 46, 56) and the second support unit (10, 46, 52) as previously described. It is understood, the second support unit (10, 46, 52) may be substituted with one of the first support unit (10, 46, 51) and the third support unit (10, 46, 54). An access way 87 is positioned at one, preferably all, doors (42, 44, 68) providing access to the tier 3 and system 2. The access way 87 provides for at least one of stairs and wheelchair access. It is understood the fifth orientation of the system may be applied to any embodiment of the tiers (3, 3', 3") of the system 2.

Figure 11:
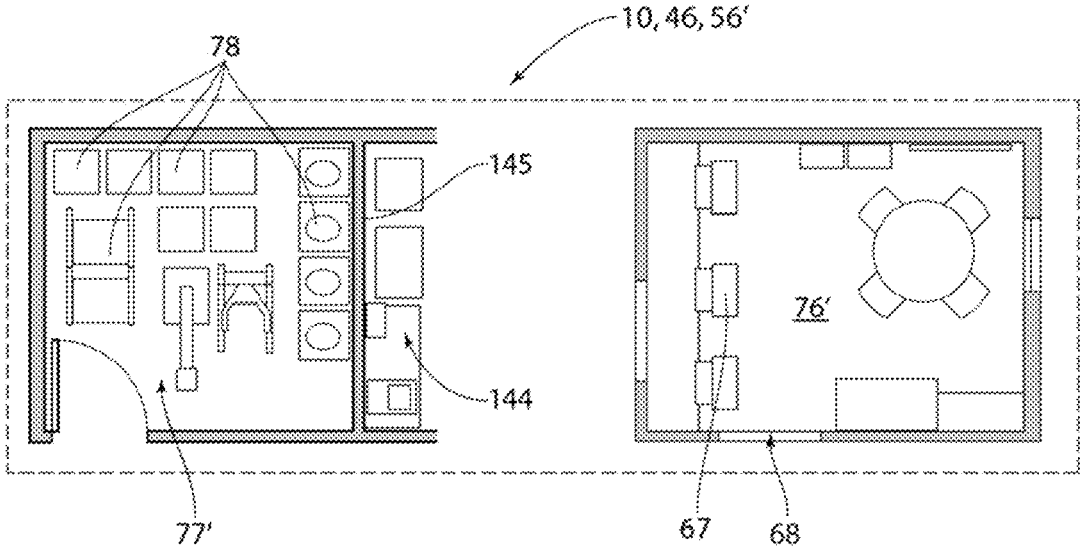
FIG. 11, is a top view of an alternative embodiment of the fifth support unit.

With attention to FIG. 11, an alternative embodiment of the fifth support unit (10, 46, 56') is provided. The alternative embodiment (10, 46, 56') comprises two room modules, the computer room module 76' and the therapy equipment storage room module 77'. The alternative embodiment (10, 46, 56') may incorporate at least one feature of the fifth embodiment of the support module (10, 46, 56). The computer room module 76' may incorporate a door 68 for access into the computer room module (10, 46, 56'). The therapy equipment storage room module 77' may incorporate a support workstation 144 along the module 77'. Preferably, the station 144 is located along the exterior of the module 145.

Figure 12:
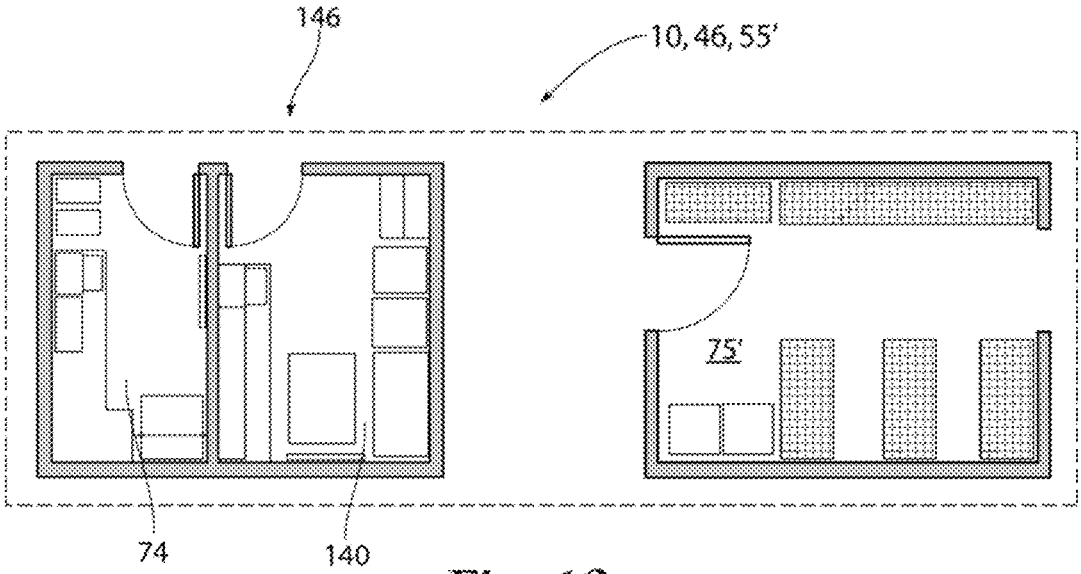
FIG. 12, is a top view of an alternative embodiment of the fourth support unit.

With attention to FIG. 12, an alternative embodiment of the fourth support unit (10, 46, 55') is provided. The alternative embodiment (10, 46, 55') comprises two room modules, the all-purpose room module 75' and the nutrition and medication preparation room module 146. The alternative embodiment (10, 46, 55') may incorporate at least one feature of the fourth embodiment of the support module (10, 46, 55). The nutrition and medication preparation room module 146 comprises the preparation room 74 and medication storage 140 as previously described.

It should be understood that the use of any orientation or directional terms herein is not intended to imply only a single orientation of the item with which it is associated or to limit the present disclosure in any manner. The use of such orientation or directional terms is intended to assist with the understanding of principles disclosed herein.

It should also be understood that use of numerical terms should not be interpreted to imply an order or sequence of components or functions. Moreover, use of these numerical terms is not intended to pertain to only the component and/or function with which they are utilized. Rather, the use of these numerical terms are merely used to assist the reader with understanding the subject matter of the present disclosure.

The present invention has optimized the efficiency of patient care, provided greater options in building layout for expanded healthcare units, and reduced the costs associated with expanding patient care. The units of the present invention are configurable along a transverse axis of the unit allowing for optimized use of space. Additionally, the units are combined without the need for a locking mechanism. This allows the system to be expandable. The units are transportable upon a tractor-trailer flatbed, airplane or train car reducing transportation cost per unit. Finally, the system is a separate unit, which is stand alone or attached to an existing structure, and therefore has specific locations for personnel to immediately access personal protection features.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is described by the specification.

We claim:

1. A modular configurable hospital system for housing and treating patients, said system comprising:
- a plurality of discrete, individually transportable patient units, each of said units comprising:
  - one or more walls;
  - a frame defining the walls of the patient units, said frame comprising:
    - a base having a footing member;
    - a top having a head member;
    - a plurality of support beams extending between said footing member and said head member, wherein at least one of the support beams is diagonal;
  - a pair of subsections;
  - a corridor located between said subsections, said corridor having an entrance to each of said subsections;
  - at least one door located within said corridor on one of said walls;

wherein at least a portion of the frame is composed of wood, and wherein said plurality of units abut one another in a secured fashion, said abutment forming a seal there between without any fastening mechanisms, thereby providing a controlled environment for housing and treating said patients in said hospital system.

2. The hospital system according to claim 1, wherein four patient units are in combination to provide for a patient section.

3. The hospital system of claim 1, wherein one of said patient units is at least one of an intensive care unit and an airborne infectious unit.

4. The hospital system according to claim 1, wherein said patient units are separable from one another.

5. The hospital system according to claim 1, wherein at least one of said patient units has a negative pressure ventilation.

6. The hospital system according to claim 1, wherein said patient unit comprises two long axis sides separated by two transverse sides.

7. The hospital system according to claim 6, wherein said seal is formed by the abutment of a transverse side of each of the respective patient units.

8. A modular configurable hospital system for housing and treating patients, said system comprising:

a pair of patient sections positioned linearly with one another, said patient sections comprising:

a plurality of discrete, individually transportable patient units, each of said units comprising:

one or more walls;

a frame defining the walls of the patient units, said frame comprising:

a base having a footing member;

a top having a head member;

a plurality of support beams extending between said footing member and said head member, wherein at least one of the support beams is diagonal;

a pair of subsections;

a corridor located between said subsections, said corridor having an entrance to each of said subsections;

at least one door located on one of said walls;

wherein at least a portion of the frame is composed of wood, and a support section accessible to said patient sections located between said patient sections;

wherein said patient sections abut said support section in a secured fashion, said abutments forming a seal there between without any locking mechanisms, thereby providing a controlled environment for housing and treating said patients in said hospital system.

9. The hospital system according to claim 8, wherein said support section is accessible to said patient sections.

10. The hospital system according to claim 8, wherein said support section comprises at least one support unit consisting of one or more of: an office, a communications room, an electronics room, a loading dock, waste removal access, a food preparation room, a medical storage room, and an equipment storage room.

11. A method of assembling a modular hospital for treating patients at a hospital site comprising the steps of:

providing a plurality of discrete, stand-alone hospital units, each of said units comprising:

one or more walls;

a frame defining the walls of the hospital units, said frame comprising:

a base having a footing member;

a top having a head member;

a plurality of support beams extending between said footing member and said head member, wherein at least one of the support beams is diagonal;

a pair of subsections;

a corridor located between said subsections, said corridor having an entrance to each of said subsections;

at least one door located within said corridor on one of said walls;

wherein at least a portion of the frame is composed of wood;

transporting said hospital units to said hospital site;

abutting said hospital units to one another to form said modular hospital;

forming a seal between said hospital units without use of any fastening mechanisms; and providing a controlled environment for housing and treating said patients in said hospital.

12. The method of claim 11 wherein said stand-alone hospital units are selected patient units and support units.

13. The method of claim 12, wherein at least one of said patient units is an airborne infectious unit.

14. The method of claim 12 further including the step of:

providing a negative pressure ventilation to at least one of said patient units and said support units.

* * * * *